US006510807B2

(12) United States Patent
Gottfried

(10) Patent No.: US 6,510,807 B2
(45) Date of Patent: Jan. 28, 2003

(54) PRE-FABRICATED FIREPROOF BULKHEAD WITH SPECIAL INTERLOCKING JOINTS FOR A SHIP

(75) Inventor: Samuel Gottfried, Upper Saddle River, NJ (US)

(73) Assignee: No Fire Technologies, Inc.

( * ) Notice: Subject to any disclaimer, the term of this patent is extended or adjusted under 35 U.S.C. 154(b) by 0 days.

(21) Appl. No.: 09/769,816

(22) Filed: Jan. 26, 2001

(65) Prior Publication Data

US 2002/0100404 A1 Aug. 1, 2002

(51) Int. Cl.[7] ..... B63B 3/56
(52) U.S. Cl. ..... 114/78
(58) Field of Search ..... 114/78, 74 R, 114/74 A, 65 R, 69; 52/783.12, 783.13, 784.1, 784.11, 784.15, 794.1

(56) References Cited

U.S. PATENT DOCUMENTS 3,313,073 A * 4/1967 Mathews ..... 52/309.2
3,570,199 A * 3/1971 Gartner ..... 52/168
3,934,066 A * 1/1976 Murch ..... 428/248
4,027,444 A * 6/1977 Berg ..... 52/240
4,038,799 A * 8/1977 Shanks ..... 52/241
4,119,755 A * 10/1978 Hoyer ..... 428/284
4,261,146 A * 4/1981 Holmes ..... 52/238
4,395,453 A * 7/1983 Lines, Jr. et al. ..... 428/216
4,441,293 A * 4/1984 McQueen et al. ..... 52/377
4,879,320 A * 11/1989 Hastings ..... 523/173
4,914,880 A * 4/1990 Albertini ..... 52/243
5,402,615 A * 4/1995 Knott et al. ..... 52/309.1
5,487,946 A * 1/1996 McGinniss et al. ..... 428/413

* cited by examiner

*Primary Examiner*—S. Joseph Morano
*Assistant Examiner*—Ajay Vasudeva
(74) *Attorney, Agent, or Firm*—Ezra Sutton

(57) ABSTRACT

A prefabricated fireproof bulkhead section for a ship. The fireproof bulkhead section includes an inner core layer made of an incombustible fiber material and having a first side for receiving a first composite and a second side for receiving a second composite for forming a fireproof bulkhead section. The first composite includes a first metal layer formed of a metal sheet, a first ceramic layer formed of ceramic fibers, a first foil layer formed of a metal foil sheet and a first outer layer formed of an intumescent, fire-retardant coating on a fiberglass sheet; and the second composite includes a second metal layer formed of a metal sheet, a second ceramic layer formed of ceramic fibers, a second foil layer formed of a metal foil sheet and a second outer layer formed of an intumescent, fire-retardant coating on a fiberglass sheet. The fireproof bulkhead section further includes connecting means in the form of section locking joints for connecting and interlocking two or more of fireproof bulkhead sections together. The fireproof bulkhead section provides protection for at least 60 minutes at a temperature of up to 1700° F.; and has a weight of less than 4.5 lbs per square foot.

111 Claims, 6 Drawing Sheets

PRE-FABRICATED FIREPROOF BULKHEAD WITH SPECIAL INTERLOCKING JOINTS FOR A SHIP

FIELD OF THE INVENTION

This invention relates to a fireproof bulkhead or overhead to protect compartments of ships, boats, submarines, aircraft, railway tanker cars, and tanker trucks. More particularly, the fireproof ship's bulkhead includes an inner core fireproof layer with adjoining outer metal layers and outer insulation layers with intumescent fire retardant coatings on woven fiberglass material on the metal layers.

1. Background of the Invention

Fireproof panels for bulkheads and overheads have been used for many years in compartments of ships, aircraft and the like, for protection against fire in many areas of the ship especially those where there is a potential source of ignition or a potential leakage of flammable liquids or gases. In these areas, it is important to separate the potential ignition sources and any such leakage from combustible areas that could lead to a major explosion or fire in a craft. Areas within these aircraft or ships in which this separation is required are defined as fire zones and are required by various governmental agencies to be separated from other areas of the aircraft or ships by fireproof firewalls. Under the United States Coast Guard regulations, fireproofing means the structure must be able to withstand exposure to heat and flames and withstand exposure to 1700 degrees Fahrenheit heat for up to 60 minutes, depending upon the location of the bulkhead. The standards required by the U.S. Coast Guard and the International Maritime Organization are included in IMO Resolution A.754(18) and are exposed for up to 60 minutes, depending on the location.

Typical designated fire zones include the regions in which are located engines turbines or furnaces, any auxiliary power units, fuel burning heaters, and other combustion equipment intended for in-transit use. In ships, the oil burning furnaces and steam generators must be isolated from the rest of the ship by properly rated firewalls and overheads. In addition, substrates such as steel, aluminum, and many types of composites made of vinyl esters, polyesters, and other types of resins require a rated firewall for the fireproofing.

Typical bulkheads and overheads of a ship are fire protected by using insulation blankets or insulation panels that are fastened to the sides of the bulkhead after the bulkhead is installed. These blankets are impractical or provide reduced performance for many reasons such as heavy weight, thickness, durability, and the requirement of a coating or surface finishing which adds a flammable top layer and significant additional expense. In addition, spray-on fireproof coatings are relatively difficult and time-consuming to apply and inspect, and are subject to cracking and peeling which must be repaired or replaced frequently. This adds up to increased installation costs, further maintenance costs and increased downtime for the ships involved.

There remains a need for a fire protective bulkhead or overhead having the following desirable features of being thin and lightweight, having high performance standards such as meeting the Coast Guard A60 requirement, a finished surface which requires no top coating, and a low surface flame spread complying with the SOLAS code (Safety of Life at Sea) of the IMO (International Maritime Organization), low smoke and toxicity requirements (IMO Resolution A.653(16) and MSC.41(64)), being easy to install which requires only a simple overlap joint with no reinforcement, and requires no additional installation of blankets or any other type of fireproofing materials, is completely dry, non-toxic and environmentally safe.

2. Description of the Prior Art

Fireproof panels for bulkheads and overheads of various designs, structures, configurations and materials of construction have been disclosed in the prior art. For example, U.S. Pat. No. 5,830,319 discloses a flexible fire barrier felt. This is a fire barrier wall, which is a replacement for a ceramic blanket or mineral wool. This patent refers to only one component of a system, and does not refer to the entire bulkhead structure.

U.S. Pat. No. 5,564,243 discloses an insulative wall cladding having insulating boards fitting together to form channels and having fire-retardant panels disposed therein. This patent describes alternate methods of constructing walls in a building primarily for water and air pressure resistance at ambient temperature. The use of flame resistant materials allows the wall to have a reduced flame spread rating, but does not provide protection from fire penetration and this insulative wall will not comply with a 60-minute bulkhead fire test according to the IMO Resolution.

U.S. Pat. No. 5,402,615 discloses a fire retardant barrier system having a fire barrier wall for a building. This fire barrier wall features a layer of inorganic fiber material sandwiched between two high conductivity panels. The panels and blankets are joined together with a wound filament. The panel members are made of copper, aluminum, or silver. Copper and silver are very expensive. The performance of the aluminum in this invention is substantially poorer than the copper or silver, due to its reduced thermal conductivity. The wound metal wire is labor intensive and very expensive to install. Joints are cumbersome, complicated and not easily installed and require stitching with filaments. In order to achieve a 60 minute fire rating this bulkhead is complex, expensive, difficult to install, and requires complicated manufacture. This technique is not an improvement of the prior art techniques of using insulation blankets on bulkheads.

U.S. Pat. No. 5,397,201 discloses a wall assembly for offshore use, suitable for applications on ships, ocean drilling rigs and platforms and the like. This patent design includes fiber-reinforced polymers as a skin with a core made of balsa wood. The panels are welded to the wall structures and require complex installation. The weight of an 8 ft. by 8 ft. section of this structure is 857 lbs. This is only 211 lbs. less than a typical bulkhead construction. By contrast, the bulkhead of the present invention is less than 300 lbs. for the same size.

U.S. Pat. No. 4,119,755 discloses a fire retardant plate material. This fire retardant plate material may be incorporated in a wall or bulkhead in place of mineral wool or ceramic blankets. It may be a substitute for mineral wool, one component of the system, but is not a stand-alone bulkhead.

U.S. Pat. No. 4,914,880 discloses a fire retardant partition wall having multiple panels therein for erection within a masonry structure. This wall prevents the passage of fire and smoke but is not designed for 60-minute fire protection according to IMO and U.S. Coast Guard requirements. It is heavy, expensive, and difficult to install and join together.

U.S. Pat. No. 5,099,625 discloses a partition wall for openings in building shells for providing a fire protection cushion for the openings in these partitioned walls. It is constructed with fiberglass and mineral materials. These are fillers for bulkheads but not stand-alone bulkheads.

U.S. Pat. No. 5,261,555 discloses a flexible insulation panel for a drum and dryer apparatus with insulation.

None of the aforementioned prior art patents disclose the particular structure and design of the fireproof bulkhead of the present invention.

Accordingly, it is an object of the present invention to provide a fireproof bulkhead made from an incombustible material inner core with outer metal layers and multiple insulation layers for use as a fireproof, flame and heat resistant bulkhead or overhead for protection of ships, aircraft, railway tanker cars, tanker trucks, and the like.

Another object of the present invention is to provide a fireproof bulkhead that is thin and lightweight, easily installed, requires no finish coat or topcoat, and requires no complicated joining techniques.

Another object of the present invention is to provide a fireproof bulkhead with a surface that has a low flame spread, smoke, and toxicity according to the requirements of the United States Coast Guard and International Maritime Organization Resolutions (IMO Resolution A.653(16) and Resolution MSC.41(64).)

Another object of the present invention is to provide a fireproof bulkhead that is completely prefabricated, with slide-in joining, requiring no cumbersome, complex, or time-consuming installation such as welding, wiring etc.

Another object of the present invention is to provide a fireproof bulkhead that requires no spraying, wiring, meshes, epoxies, glues, or any complicated installation techniques.

Another object of the present invention is to provide a fireproof bulkhead that allows for easy through penetrations for pipes, cables, conduits or the like.

Another object of the present invention is to provide a fireproof bulkhead that includes a decorative, attractive finish in any color.

Another object of the present invention is to provide a fireproof bulkhead that is strong, tough, durable, water resistant, and useful in all locations on a ship.

Another object of the present invention is to provide a fireproof bulkhead that requires no epoxies, no glues, no sealants, and no cumbersome liquids or chemicals to apply.

Another object of the present invention is to provide a fireproof bulkhead that meets the sound attenuation requirements of a ship compartment by the U.S. Coast Guard and IMO.

Another object of the present invention is to provide a fireproof bulkhead that complies with the requirements of the U.S. Coast Guard and International Maritime Organization Resolution A.754(18).

Another object of the present invention is to provide a fireproof bulkhead that can be used in a variety of areas in a ship including passenger compartments, vehicle decks, galleys, engine compartments, etc.

Another object of the present invention is to provide a fireproof bulkhead that can be used on many different types of ships and transportation vehicles such as tankers, railway cars, etc.

Another object of the present invention is to provide a fireproof bulkhead that is durable and resistant to normal abrasive wear and tear.

A further object of the present invention is to provide a fireproof bulkhead that can be easily manufactured, mass-produced in an automated and economical manner, and is cost-efficient for a variety of applications by the user.

SUMMARY OF THE INVENTION

In accordance with the present invention, there is provided a fireproof bulkhead section for a ship. The fireproof bulkhead section includes an inner core layer made of an incombustible fiber material and having a first side for receiving a first composite and a second side for receiving a second composite for forming the fireproof bulkhead section. The first composite includes a first metal layer formed of a metal sheet, a first ceramic layer formed of ceramic fibers, a first foil layer formed of a metal foil sheet and a first outer layer formed of an intumescent, fire-retardant coating on a fiberglass sheet; and the second composite includes a second metal layer formed of a metal sheet, a second ceramic layer formed of ceramic fibers, a second foil layer formed of a metal foil sheet and a second outer layer formed of an intumescent, fire-retardant coating on a fiberglass sheet. The fireproof bulkhead section further includes connecting means in the form of section locking joints for connecting and interlocking two or more fireproof bulkhead sections together. The fireproof bulkhead panel provides protection for at least 60 minutes at a temperature of up to 1700° F.; and has a weight of less than 4.5 lbs per square foot.

A system for supporting a plurality of fireproof bulkhead sections for a ship's bulkhead is provided. The interlocking fireproof bulkhead system includes a plurality of fireproof bulkhead sections each having an upper edge and a lower edge; a plurality of connected ceiling track members for slidably receiving the upper edges of the plurality of fireproof bulkhead sections; and a plurality of connected floor track members for slidably receiving the lower edges of the plurality of fireproof bulkhead sections. Each of the fireproof sections includes connecting means in the form of section locking joints for connecting and interlocking two or more of the fireproof bulkhead sections together. Each of the fireproof bulkhead sections includes an inner core layer made of an incombustible fiber material and having a first side for receiving a first composite and a second side for receiving a second composite for forming said fireproof bulkhead section. The first composite includes a first metal layer formed of a metal sheet, a first ceramic layer formed of ceramic fibers, a first foil layer formed of a metal foil sheet and a first outer layer formed of an intumescent, fire-retardant coating on a fiberglass sheet; and the second composite includes a second metal layer formed of a metal sheet, a second ceramic layer formed of ceramic fibers, a second foil layer formed of a metal foil sheet and a second outer layer formed of an intumescent, fire-retardant coating on a fiberglass sheet. The interlocking fireproof bulkhead paneling system provides protection for at least 60 minutes at a temperature of up to 1700° F.; and has a weight of less than 4.5 lbs per square foot.

The inner core layer is made of an incombustible fiber material such as mineral wool, rock wool, ceramic blanket, silica blanket, alumina blanket, and fiberglass. Each of the metal layers are made of metal sheet material selected from the group consisting of steel, stainless steel, aluminum, and alloys of steel or aluminum. Each of the ceramic layers are made of ceramic fiber materials selected from the group consisting of ceramic blanket, silica blanket, alumina blanket and combinations thereof. Each of the metal foil layers are made of metal foil sheet material selected from the group consisting of steel, stainless steel, aluminum, copper, tantalum, and alloys of steel or aluminum. Each of the outer layers are made of an intumescent fire-retardant coating on a woven or non-woven fiberglass sheet, wherein the fiberglass sheet material is selected from the group consisting of E-type fiberglass, silica fibers and leached fiberglass.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE EMBODIMENTS OVERVIEW

Figure 1:
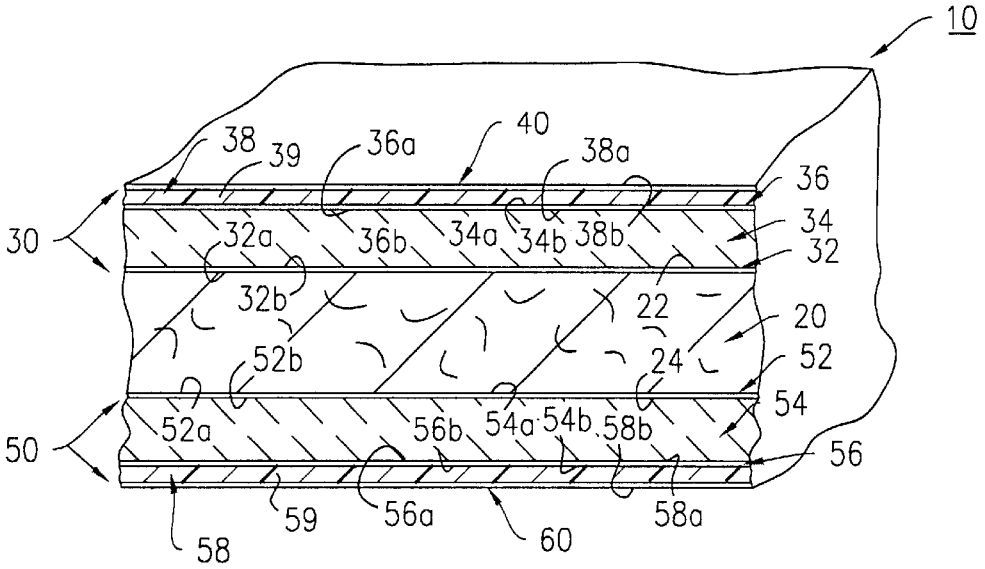
FIG. 1 is a sectionalized perspective view of the fireproof bulkhead section of the preferred embodiment of the present invention showing the inner core incombustible layer, the metal sheet layers, the ceramic insulation layers, the metal foil sheet layers, and the outer intumescent and fire retardant coating layers on fiberglass.

The fireproof bulkhead sections 10, 100, 200, 300 and 400 of the preferred and alternate embodiments of the present invention are represented in FIGS. 1 through 10 of the patent drawings. The fireproof bulkhead sections 10, 100, 200, 300 and 400 include an inner core 20, 120, 220, 320 and 420, respectively, of an incombustible fire retardant material such as mineral wool. A pair of metal skin layers 32, 52, 132, 152, 232, 252, 332, 352, 432 and 452 on each side of the inner core, respectively, provides the structural support for each of the cut and sized panel sheets or sheet sections 70, 170, 270, 370 and 470, respectively. Multiple composite layers of insulation materials are attached and bonded to each side of the metal skin layer and in forming the composite laminated structure of each fireproof bulkhead section 10, 100, 200, 300 and 400, as depicted in FIGS. 1 through 5 of the drawings.

One or more of the fabricated and pre-cut sheets or sheet sections 70, 170, 270, 370 and 470 are installed within the interlocking fireproof bulkhead system 500 for a ship's bulkhead 12. Each of the pre-cut sheets or sheet sections 70, 170, 270, 370 and 470 include connecting means 90 for joining two or more of the aforementioned sheet sections together. This interlocking fireproof bulkhead paneling system 500 provides protection from fire and heat for at least 60 minutes at a temperature of up to 1700 degrees Fahrenheit. The assembled and interlocked fireproof bulkhead system 500 has a weight of less than 4.5 lbs per square foot.

Preferred Embodiment 10

Figures 6, 10:
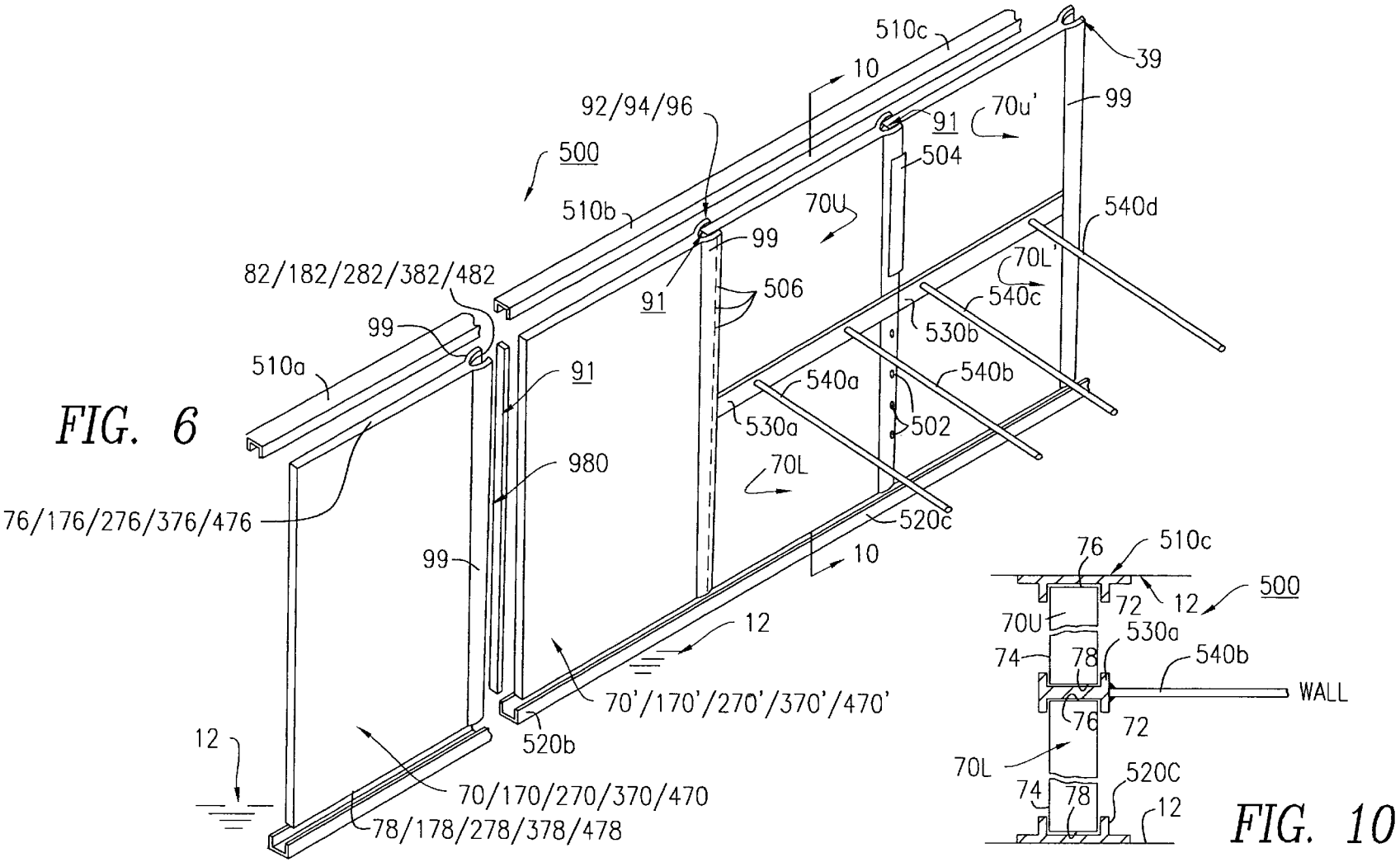
FIG. 6 is a perspective view of the fireproof bulkhead section of the preferred embodiment of the present invention showing the interlocking fireproof system in an assembled state and in operational use in a ship's bulkhead.
FIG. 10 is a cross-sectional view of the fireproof bulkhead section of the preferred embodiment showing the interlocking sheets being held with the connecting means within the interlocking fireproof bulkhead system.

The fireproof section 10 for a ship's bulkhead 12 of the preferred embodiment of the present invention are represented in FIGS. 1 and 6 of the patent drawings. Fireproof section 10 of the preferred embodiment of the present invention includes an inner core layer 20 made of mineral wool having a first side 22 for receiving a first composite laminated structure 30 and a second side 24 for receiving a second composite laminated structure 50 for forming the fireproof section 10 for a ship's bulkhead 12, as depicted in FIG. 1 of the drawings. The fireproof section 10 when manufactured is pre-cut and sized into sheet sections 70 for installation as a particular ship's bulkhead 12, as shown in FIG. 6 of the drawings.

The first composite laminated structure 30 includes a first metal layer 32 formed of a metal sheet, a first ceramic layer 34 formed of ceramic fibers, a first foil layer 36 formed of a metal foil and a first outer layer 38 formed of an intumescent, fire-retardant coating on a fiberglass woven or non-woven textile sheet 39, as depicted in FIG. 1. First metal layer 32 includes a first side 32*a* and a second side 32*b*. First ceramic layer 34 includes a first side 34*a* and a second side 34*b*. First foil layer 36 includes a first side 36*a* and a second side 36*b*. First outer layer 38 includes a first side 38*a* and a second side 38*b*. The first composite laminated structure 30 is constructed in the following manner, the first side 32*a* of first metal layer 32 is adjacent and in contact with first side 22 of the inner core layer 20. The second side 32*b* of first metal layer 32 is adjacent and in contact with first side 34*a* of first ceramic layer 34. The second side 34*b* of first ceramic layer 34 is adjacent and in contact with first side 36*a* of first foil layer 36. The second side 36*b* of first foil layer 36 is adjacent and in contact with first side 38*a* of first outer layer 38. Second side 38*b* is the outer wall surface of first composite laminated structure 30.

The second composite laminated structure 50 includes a second metal layer 52 formed of a metal sheet, a second ceramic layer 54 formed of ceramic fibers, a second foil layer 56 formed of a metal foil and a second outer layer 58 formed of an intumescent, fire retardant coating on a fiberglass woven or non-woven textile sheet 59, as depicted in FIG. 1 of the drawings. Second metal layer 52 includes a first side 52*a* and a second side 52*b*. Second ceramic layer 54 includes a first side 54*a* and a second side 54*b*. Second foil layer 56 includes a first side 56*a* and a second side 56*b*. Second outer layer 58 includes a first side 58*a* and a second side 58*b*. The second composite laminated structure 50 is constructed in the following manner, the first side 52*a* of second metal layer 52 is adjacent and in contact with second side 24 of the inner core layer 20. The second side 52*b* of second metal layer 52 is adjacent and in contact with first side 54*a* of second ceramic layer 54. The second side 54*b* of second ceramic layer 54 is adjacent and in contact with first side 56*a* of second foil layer 56. The second side 56*b* of second foil layer 56 is adjacent and in contact with first side 58*a* of second outer layer 58. Second side 58*b* is the outer wall surface of second composite laminate structure 50.

Inner core layer 20 is made of a fire retardant and incombustible material selected from the group consisting of mineral wool, rock wool, ceramic blanket, silica blanket, alumina blanket and combinations thereof Inner core layer 20 of mineral wool has a thickness in the range of ½ of an inch to 3 inches, with a preferred thickness of 2 inches, and having a density of at least 1 pound per cubic foot with a preferred density of 4 pounds per cubic foot.

First and second metal layers 32 and 52 are used as metal structural sheets for providing structural integrity to the formed fireproof section 10 and are made of metal sheets selected from the group consisting of steel, stainless steel, aluminum, and alloy layers of steel or aluminum. Metal layers 32 and 52 each have a thickness in the range of 20 mils to 200 mils with a preferred thickness of 30 mils.

First and second ceramic layers 34 and 54 are used as an insulation blanket for reducing the transmission of heat and are made of materials selected from the group consisting of ceramic blankets, silica blankets, alumina blankets, mineral wool, rock wool, fiberglass, leached silica and combinations thereof. Ceramic layers 34 and 54 each have a thickness in the range of 125 mils to 500 mils with a preferred thickness of 250 mils depending upon the material used, and has a density of at least 4 pounds per cubic foot.

First and second foil layers 36 and 56 are used for reflecting heat and eliminates the convection transfer of heat. Foil layers 36 and 56 are made of metal foil sheets selected from the group consisting of steel foil, stainless steel foil, aluminum foil, copper foil, tantalum foil, and alloys of stainless steel or aluminum foil. Foil layers 36 and 56 each have a thickness in the range of 1 mil to 20 mils with a preferred thickness of 2 mils.

First and second outer layers 38 and 58 are used as the fireproof and fire retardant layers in retarding fire on fireproof panel 10, and are made of intumescent, fire retardant coatings on either woven or non-woven textile sheets 39. Further, additional top coat layers 40 and 60 can be applied to first and second outer layers 38 and 58, respectively, in order to increase durability, water resistance, resistance to humidity, resistance to impact, and resistance to chemicals and hydrocarbons. The combined outer layers 38 and 40, and 58 and 60 include the fiberglass textile 39 and 59 having intumescent coatings thereon for resistance to fire, heat, water and impact. Outer layers 38 and 58 each have a thickness in the range of 15 mils to 200 mils with a preferred thickness of 30 mils.

Figure 7:
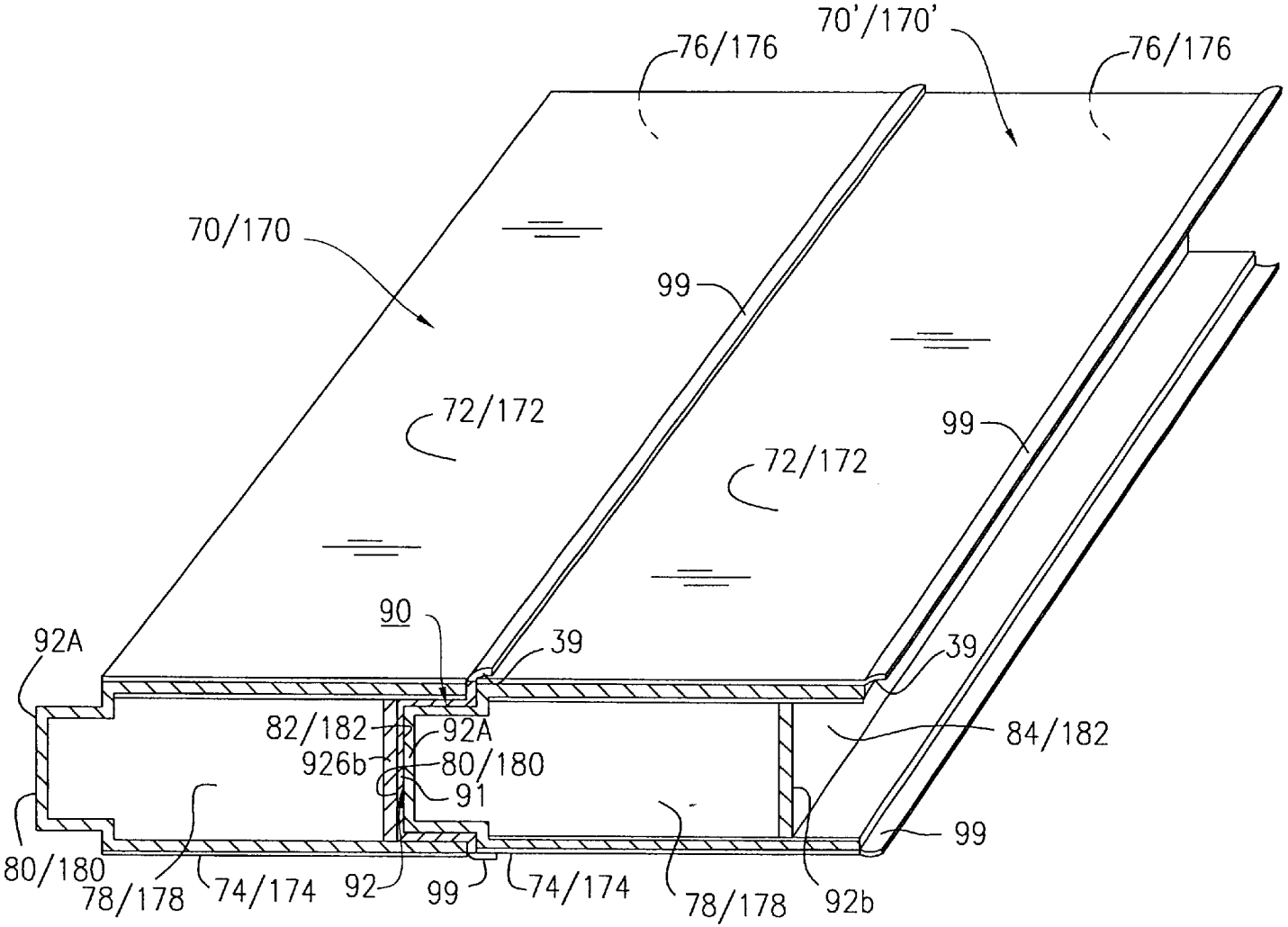
FIG. 7 is a perspective view of the fireproof bulkhead section of the preferred embodiment showing two sheets being interlocked with an overlap joint and a barrier overlap member.

Sheet section 70 includes outer wall surfaces 72 and 74, upper and lower edges 76 and 78 and side edges 80 and 82. The physical measurements of sheet section 70 (in a pre-cut and assembled state), as depicted in FIGS. 6 and 7 of the drawings has a thickness of 2 inches, and height and width measurements that are adjusted to a particular size for the ship's bulkhead 12 in which two or more of these sheet sections 70 are installed within the interlocking fireproof bulkhead system 500. Sheet section 70 also includes connecting means 90 for joining two or more sheet sections 70 together. The connecting means 90 include overlap joints 92, half-lap joints 94, or tongue and groove joints 96, wherein each of the aforementioned joints are made of metal and also include a pair of barrier overlap members 99, as shown in FIGS. 7 through 10 of the drawings. The barrier overlap members 99 are located on side 82 of each sheet section 70. Each of the male and female members 92*a* and 92*b*, 94*a* and 94*b* and 96*a* and 96*b* of the joints 92, 94 and 96 respectively, can be located on each side 80 and 82 of each sheet section 70.

First Alternate Embodiment 100

Figure 2:
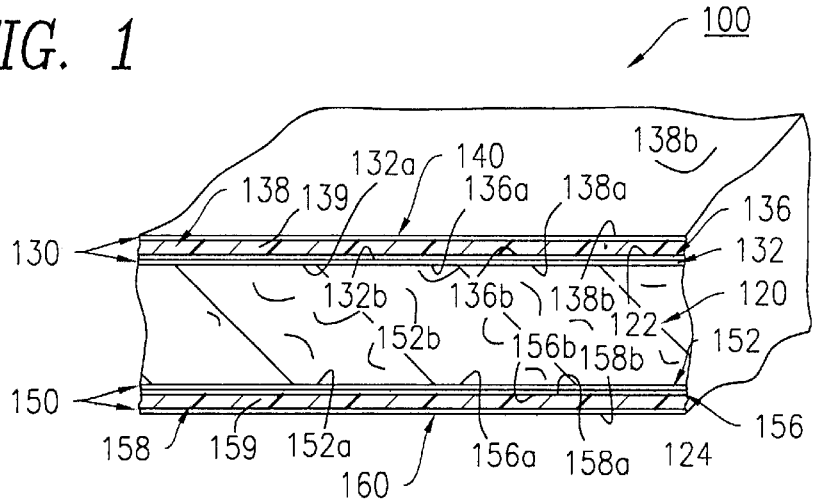
FIG. 2 is a sectionalized perspective view of the fireproof bulkhead section of the first alternate embodiment of the present invention showing the inner core incombustible layer, the metal sheet layers, the metal foil sheet layers, and the outer intumescent and fire retardant coating layers on fiberglass.

The fireproof section 100 for a ship's bulkhead 12 of the first alternate embodiment of the present invention are represented in FIGS. 2 and 7 of the patent drawings. Fireproof section 100 of the first alternate embodiment of the present invention includes an inner core layer 120 made of mineral wool having a first side 122 for receiving a first composite laminated structure 130 and a second side 124 for receiving a second composite laminated structure 150 for forming the fireproof section 100 for a ship's bulkhead 12, as depicted in FIG. 2 of the drawings. The fireproof section 100 when manufactured is pre-cut and sized into a sheet section 170 for installation as a particular ship's bulkhead 12, as shown in FIG. 7 of the drawings.

The first composite laminated structure 130 includes a first metal layer 132 formed of a metal sheet, a first foil layer 136 formed of a metal foil and a first outer layer 138 formed of an intumescent, fire-retardant coating on a fiberglass woven or non-woven textile sheet 139, as depicted in FIG. 2. First metal layer 132 includes a first side 132*a* and a second side 132*b*. First foil layer 136 includes a first side 136*a* and a second side 136*b*. First outer layer 38 includes a first side 138*a* and a second side 138*b*. The first composite laminated structure 30 is constructed in the following manner, the first side 132*a* of first metal layer 132 is adjacent and in contact with first side 122 of the inner core layer 120. The second side 132*b* of first metal layer 132 is adjacent and in contact with first side 136*a* of first foil layer 136. The second side 136*b* of first foil layer 136 is adjacent and in contact with first side 138*a* of first outer layer 138. Second side 138*b* is the outer wall surface of first composite laminated structure 130.

The second composite laminated structure 150 includes a second metal layer 152 formed of a metal sheet, a second foil layer 156 formed of a metal foil and a second outer layer 158 formed of an intumescent, fire retardant coating on a fiberglass woven or non-woven textile sheet 159, as depicted in FIG. 2 of the drawings. Second metal layer 152 includes a first side 152*a* and a second side 152*b*. Second foil layer 156 includes a first side 156*a* and a second side 156*b*. Second outer layer 158 includes a first side 158*a* and a second side 158*b*. The second composite laminated structure 150 is constructed in the following manner, the first side 152*a* of second metal layer 152 is adjacent and in contact with second side 124 of the inner core layer 120. The second side 152*b* of second metal layer 152 is adjacent and in contact with first side 156*a* of second foil layer 156. The second side 156*b* of second foil layer 156 is adjacent and in contact with first side 158*a* of second outer layer 158. Second side 158*b* is the outer wall surface of second composite laminate structure 150.

Inner core layer 120 is made of a fire retardant material selected from the group consisting of mineral wool, rock wool, ceramic blanket, silica blanket, alumina blanket and combinations thereof. Inner core layer 120 of mineral wool has a thickness in the range of ½ of an inch to 3 inches with a preferred thickness of 2 inches, and having a density of at least 1 pound per cubic foot with a preferred density of 4 pounds per cubic foot.

First and second metal layers 132 and 152 are used as metal structural sheets for providing structural integrity to the formed fireproof panel 100 and are made of metal sheets selected from the group consisting of steel, stainless steel, aluminum, and alloy layers of steel or aluminum. Metal layers 132 and 152 each have a thickness in the range of 20 mils to 200 mils with a preferred thickness of 30 mils.

First and second foil layers 136 and 156 are used for reflecting heat and eliminates the convection transfer of heat. Foil layers 136 and 156 are made of metal foil sheets selected from the group consisting of steel foil, stainless steel foil, aluminum foil, copper foil, tantalum foil, and alloys of stainless steel or aluminum foil. Foil layers 136 and 156 each have a thickness in the range of 1 mil to 20 mils with a preferred thickness of 2 mils.

First and second outer layers 138 and 158 are used as the fireproof and fire retardant layers in retarding fire on fireproof section 100, and are made of intumescent, fire retardant coatings on either woven or non-woven textile sheets 139. Further, additional top coat layers 140 and 160 can be applied to first and second outer layers 138 and 158, respectively, in order to increase durability, water resistance, resistance to humidity, resistance to impact, and resistance to chemicals and hydrocarbons. The combined outer layers 138 and 140, and 158 and 160 include the fiberglass textile 139 and 159 having intumescent coatings thereon for resistance to fire, heat, water and impact. Outer layers 138 and 158 each have a thickness in the range of 15 mils to 200 mils with a preferred thickness of 30 mils.

Sheet section 170 includes outer wall surfaces 172 and 174, upper and lower edges 176 and 178 and side edges 180 and 182. The physical measurements of sheet section 170 (in a cut and assembled state), as depicted in FIG. 7 of the drawings has a thickness of 2 inches, and height and width measurements that can be manufactured to any size for the particular ship's bulkhead 12 in which one or more of these sheet sections 170 are installed within the interlocking fireproof bulkhead system 500. Sheet section 170 also includes connecting means 90 for joining two or more sheet sections 170 together. The connecting means 90 include overlap joints 92, half-lap joints 94, or tongue and groove joints 96 wherein each of the aforementioned joints are made of metal and also include a pair of barrier overlap members 99, as shown in FIGS. 6 through 10 of the drawings. The barrier overlap members 99 are located on side 182 of each sheet section 170. Each of the male and female members 92*a* and 92*b*, 94*a* and 94*b*, and 96*a* and 96*b* of the joints 92, 94 and 96, respectively, are located on each side 180 and 182 of each sheet section 170.

Second Alternate Embodiment 200

Figure 3:
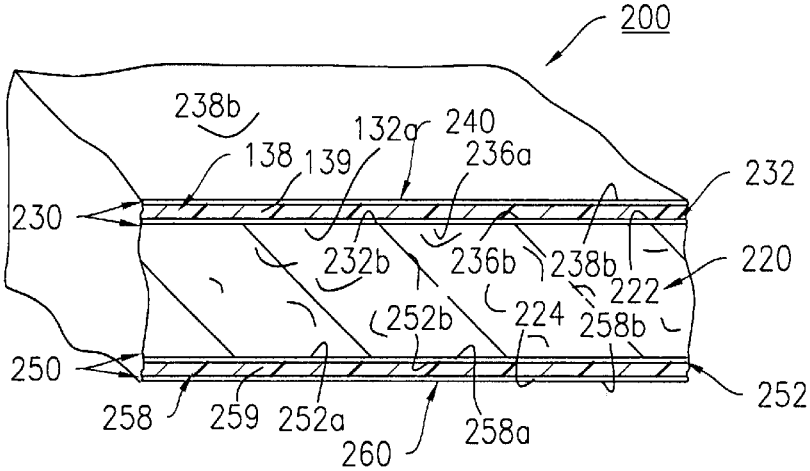
FIG. 3 is a sectionalized perspective view of the fireproof bulkhead section of the second alternate embodiment of the present invention showing the inner core incombustible layer, the metal sheet layers and the outer intumescent and fire retardant coating layers on fiberglass.
Figure 8:
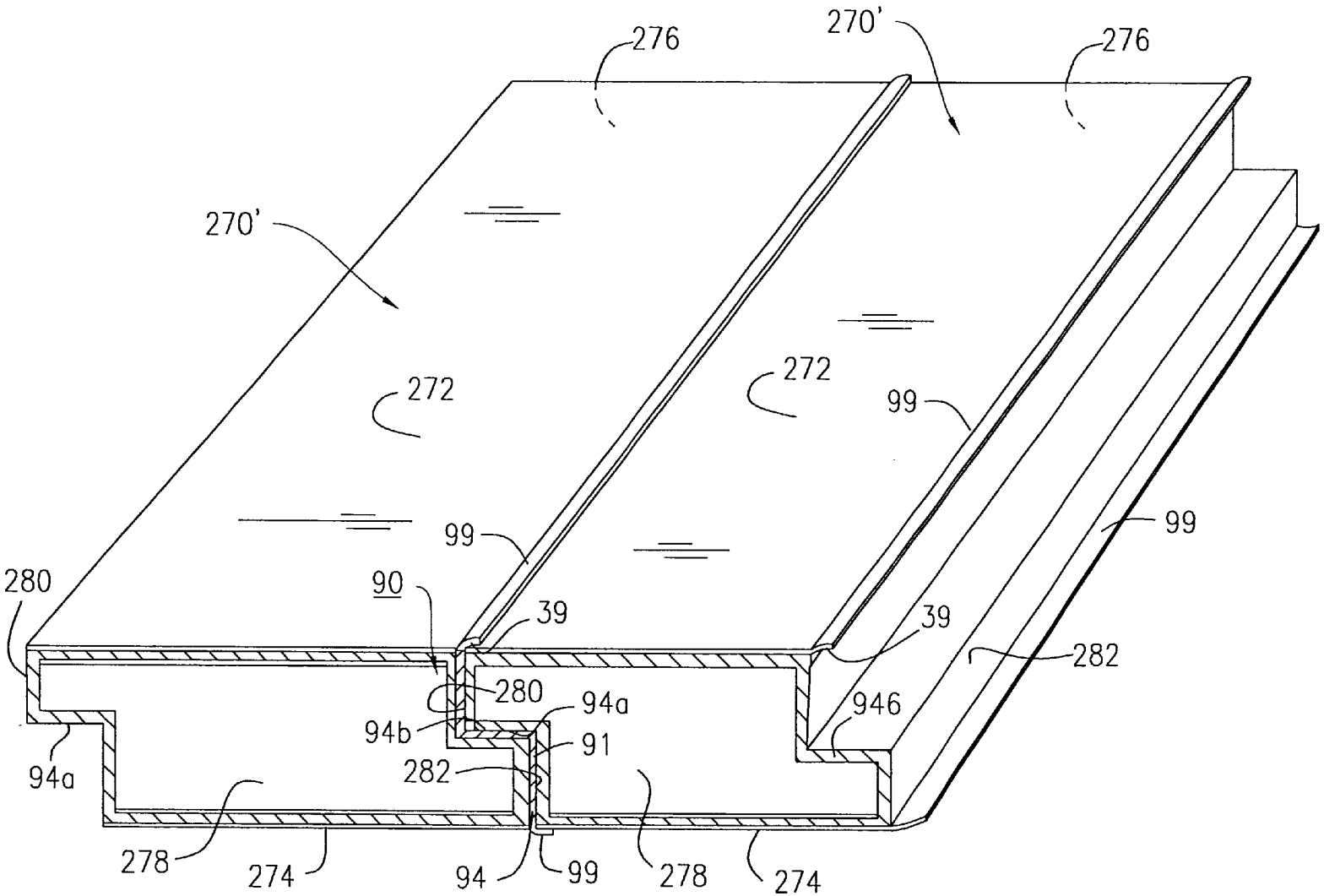
FIG. 8 is a perspective view of the fireproof bulkhead section of the first alternate embodiment showing two sheets being interlocked with a half-lap joint and a barrier overlap member.

The fireproof section 200 for a ship's bulkhead 12 of the second alternate embodiment of the present invention are represented in FIGS. 3 and 8 of the patent drawings. Fireproof section 200 of the second alternate embodiment of the present invention includes an inner core layer 220 made of mineral wool having a first side 222 for receiving a first composite laminated structure 230 and a second side 224 for receiving a second composite laminated structure 250 for forming the fireproof section 200 for a ship's bulkhead 12, as depicted in FIG. 3 of the drawings. The fireproof section 200 when manufactured is pre-cut and sized into a sheet section 270 for installation as a particular ship's bulkhead 12, as shown in FIG. 8 of the drawings.

The first composite laminated structure 230 includes a first metal layer 232 formed of a metal sheet and a first outer layer 238 formed of an intumescent, fire-retardant coating on a fiberglass woven or non-woven textile sheet 239, as depicted in FIG. 3. First metal layer 232 includes a first side 232*a* and a second side 232*b*. First outer layer 238 includes a first side 238*a* and a second side 238*b*. The first composite laminated structure 230 is constructed in the following manner, the first side 232*a* of first metal layer 232 is adjacent and in contact with first side 222 of the inner core layer 220. The second side 232*b* of first metal layer 232 is adjacent and in contact with first side 238*a* of first outer layer 238. Second side 238*b* is the outer wall surface of first composite laminated structure 230.

The second composite laminated structure 250 includes a second metal layer 252 formed of a metal sheet and a second outer layer 258 formed of an intumescent, fire retardant coating on a fiberglass woven or non-woven textile sheet 259, as depicted in FIG. 3 of the drawings. Second metal layer 252 includes a first side 252*a* and a second side 252*b*. Second outer layer 258 includes a first side 258*a* and a second side 258*b*. The second composite laminated structure 250 is constructed in the following manner, the first side 252*a* of second metal layer 252 is adjacent and in contact with second side 224 of the inner core layer 220. The second side 252*b* of second metal layer 252 is adjacent and in contact with first side 258*a* of second outer layer 258. Second side 258*b* is the outer wall surface of second composite laminate structure 250.

Inner core layer 220 is made of a fire retardant and incombustible material selected from the group consisting of mineral wool, rock wool, ceramic blanket, silica blanket, alumina blanket and combinations thereof. Inner core layer 220 of mineral wool has a thickness in the range of ½ of an inch to 3 inches with a preferred thickness of 2 inches, and having a density of at least 1 pound per cubic foot with a preferred density of 4 pounds per cubic foot.

First and second metal layers 232 and 252 are used as metal structural sheets for providing structural integrity to the formed fireproof section 200 and are made of metal sheets selected from the group consisting of steel, stainless steel, aluminum, and alloy layers of steel or aluminum. Metal layers 232 and 252 each have a thickness in the range of 20 mils to 200 mils with a preferred thickness of 30 mils.

First and second outer layers 238 and 258 are used as the fireproof and fire retardant layers in retarding fire on fireproof section 200, and are made of intumescent, fire retardant coatings on either woven or non-woven textile sheets 239. Further, additional top coat layers 240 and 260 can be applied to first and second outer layers 238 and 258, respectively, in order to increase durability, water resistance, resistance to humidity, resistance to impact, and resistance to chemicals and hydrocarbons. The combined outer layers 238 and 240, and 258 and 260 include the fiberglass textile 239 and 259 having intumescent coatings thereon for resistance to fire, heat, water and impact. Outer layers 238 and 258 each have a thickness in the range of 15 mils to 200 mils with a preferred thickness of 30 mils.

Sheet section 270 includes outer wall surfaces 272 and 274, upper and lower edges 276 and 278 and side edges 280 and 282. The physical measurements of sheet section 270 (in a cut and assembled state), as depicted in FIG. 8 of the drawings has a thickness of 2 inches, and height and width measurements that can be manufactured to any size for the particular ship's bulkhead 12 in which two or more of these sheet sections 270 are installed within the interlocking fireproof bulkhead system 500. Sheet section 270 also includes connecting means 90 for joining two or more sheet sections 270 together. The connecting means 90 include overlap joints 92, half-lap joints 94, or tongue and groove joints 96, wherein each of the aforementioned joints are made of metal and also include a pair of barrier overlap members 99, as shown in FIGS. 7 through 10 of the drawings. The barrier overlap members 99 are located on side 282 of each sheet section 270. Each of the male and female members 92*a* and 92*b*, 94*a* and 94*b*, and 96*a* and 96*b* of the joints 92, 94 and 96, respectively, are located on each side 280 and 282 of each sheet section 270.

Third Alternate Embodiment 300

Figure 4:
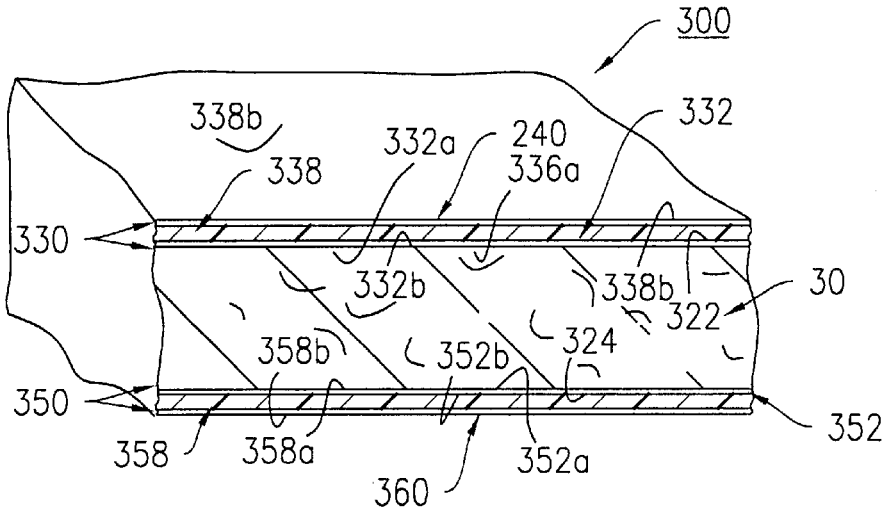
FIG. 4 is a sectionalized perspective view of the fireproof bulkhead section of the third alternate embodiment of the present invention showing the inner core incombustible layer, the metal sheet layers and the outer intumescent and fire retardant coating layers bonded to the metal sheet layers.
Figure 9:
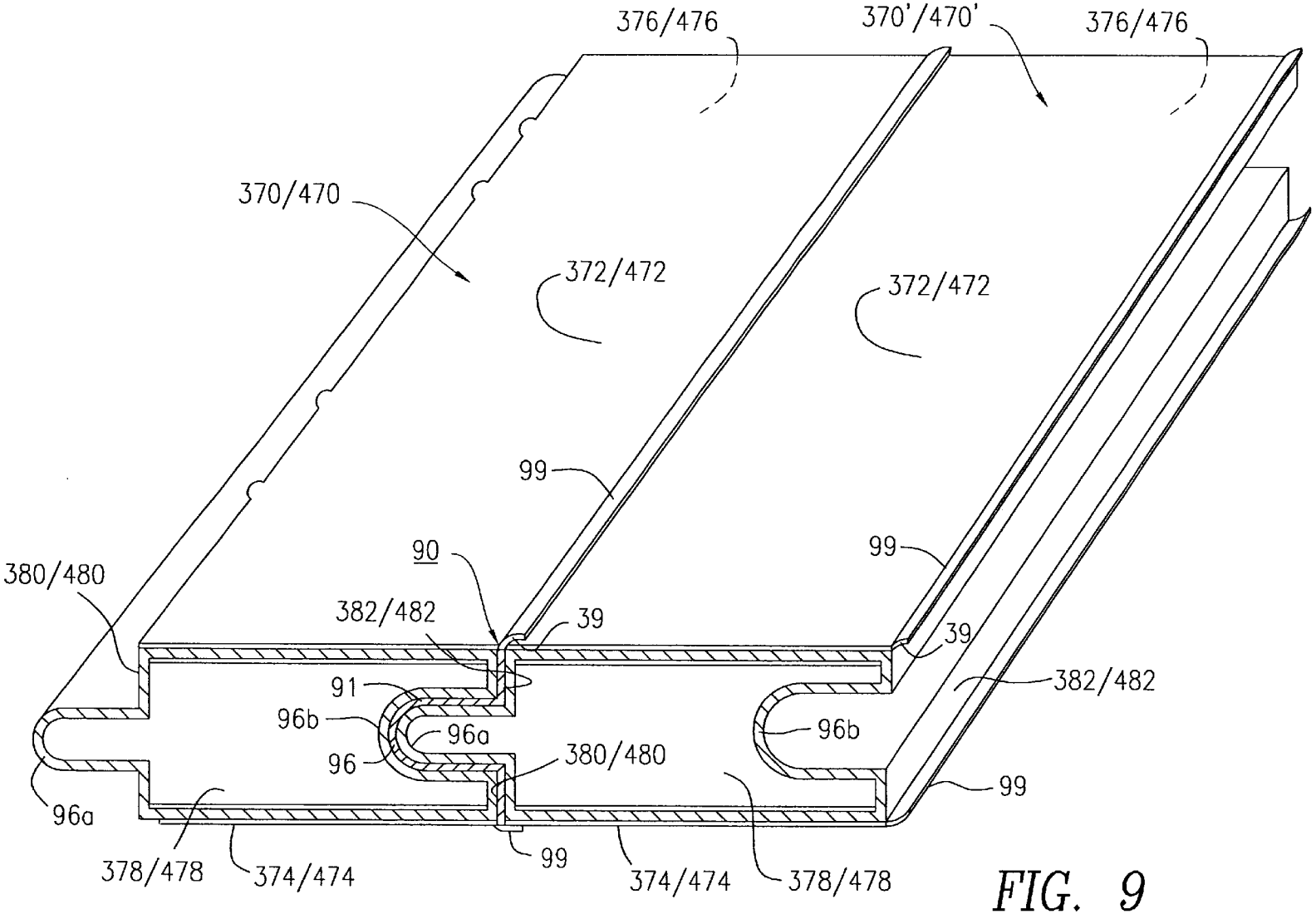
FIG. 9 is a perspective view of the fireproof bulkhead section of the third alternate embodiment showing two sheets being interlocked with a tongue and groove joint and a barrier overlap member.

The fireproof section 300 for a ship's bulkhead 12 of the third alternate embodiment of the present invention are represented in FIGS. 4 and 9 of the patent drawings. Fireproof section 300 of the third alternate embodiment of the present invention includes an inner core layer 320 made of mineral wool having a first side 322 for receiving a first composite laminated structure 330 and a second side 324 for receiving a second composite laminated structure 350 for forming the fireproof section 300 for a ship's bulkhead 12, as depicted in FIG. 4 of the drawings. The fireproof section 300 when manufactured is pre-cut and sized into a sheet section 370 for installation as a particular ship's bulkhead 12, as shown in FIG. 9 of the drawings.

The first composite laminated structure 330 includes a first metal layer 332 formed of a metal sheet and a first outer layer 338 formed of an intumescent, fire-retardant coating, as depicted in FIG. 4 of the drawings. First metal layer 332 includes a first side 332*a* and a second side 332*b*. First outer layer 338 includes a first side 338*a* and a second side 338*b*. The first composite laminated structure 330 is constructed in the following manner, the first side 332*a* of first metal layer 332 is adjacent and in contact with first side 322 of the inner core layer 320. The second side 332*b* of first metal layer 332 is adjacent and in contact with first side 338*a* of first outer layer 338. Second side 338*b* is the outer wall surface of first composite laminated structure 330.

The second composite laminated structure 350 includes a second metal layer 352 formed of a metal sheet and a second outer layer 358 formed of an intumescent, fire retardant coating, as depicted in FIG. 4 of the drawings. Second metal layer 352 includes a first side 352*a* and a second side 352*b*. Second outer layer 358 includes a first side 358*a* and a second side 358*b*. The second composite laminated structure 350 is constructed in the following manner, the first side 352*a* of second metal layer 352 is adjacent and in contact with second side 324 of the inner core layer 320. The second side 352*b* of second metal layer 352 is adjacent and in contact with first side 358*a* of second outer layer 358. Second side 358*b* is the outer wall surface of second composite laminate structure 350.

Inner core layer 320 is made of a fire retardant and incombustible material selected from the group consisting of mineral wool, rock wool, ceramic blanket, silica blanket, alumina blanket and combinations thereof. Inner core layer 320 of mineral wool has a thickness in the range of ½ of an inch to 3 inches with a preferred thickness of 2 inches, and having a density of at least 1 pound per cubic foot with a preferred thickness of 4 pounds per cubic foot.

First and second metal layers 332 and 352 are used as metal structural sheets for providing structural integrity to the formed fireproof section 300 and are made of metal sheets selected from the group consisting of steel, stainless steel, aluminum, and alloy layers of steel or aluminum. Metal layers 332 and 352 each have a thickness in the range of 20 mils to 200 mils with a preferred thickness of 30 mils.

First and second outer layers 338 and 358 are used as the fireproof and fire retardant layers in retarding fire on fireproof section 300, and are made of intumescent, fire retardant coatings on metal layers 332 and 352. Further, additional top coat layers 340 and 360 can be applied to first and second outer layers 338 and 358, respectively, in order to increase durability, water resistance, resistance to humidity, resistance to impact, and resistance to chemicals and hydrocarbons. The combined outer layers 338 and 340, and 358 and 360 having intumescent coatings thereon for resistance to fire, heat, water and impact. Outer layers 338 and 358 each have a thickness in the range of 15 mils to 200 mils with a preferred thickness of 30 mils.

Sheet section 370 includes outer wall surfaces 372 and 374, upper and lower edges 376 and 378 and side edges 380 and 382. The physical measurements of sheet section 370 (in a cut and assembled state), as depicted in FIG. 9 of the drawings has a thickness of 2 inches, and height and width measurements that can be manufactured to any size for the particular ship's bulkhead 12 in which one or more of these sheet sections 370 are installed within the interlocking fireproof bulkhead system 500. Sheet section 370 also includes connecting means 90 for joining two or more sheet sections 370 together. The connecting means 90 include overlap joints 92, half-lap joints 94, or tongue and groove joints 96, wherein each of the aforementioned joints are made of metal and also include a pair of barrier overlap members 99, as shown in FIGS. 7 through 10 of the drawings. The barrier overlap members 99 are located on side 382 of each sheet section 370. Each of the male and female members 92*a* and 92*b*, 94*a* and 94*b*, and 96*a* and 96*b*, of the joints 92, 94 and 96, respectively, are located on each side 380 and 382 of each sheet section 370.

Fourth Alternate Embodiment 400

Figure 5:
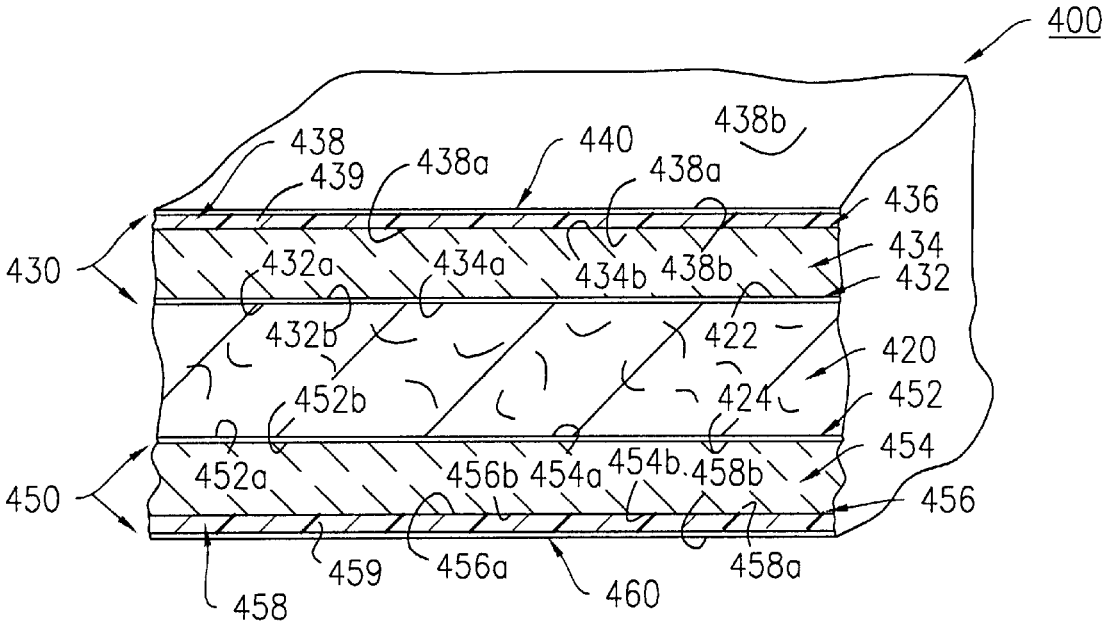
FIG. 5 is a sectionalized perspective view of the fireproof bulkhead section of the fourth alternate embodiment of the present invention showing the inner core incombustible layer, the metal sheet layers, the ceramic insulation layers and the outer intumescent and fire retardant coating layers on fiberglass.

The fireproof section 400 for a ship's bulkhead 12 of the fourth alternate embodiment of the present invention are represented in FIGS. 5 and 9 of the patent drawings. Fireproof section 400 of the fourth alternate embodiment of the present invention includes an inner core layer 420 made of mineral wool having a first side 422 for receiving a first composite laminated structure 430 and a second side 424 for receiving a second composite laminated structure 450 for forming the fireproof section 400 for a ship's bulkhead 12, as depicted in FIG. 5 of the drawings. The fireproof section 400 when manufactured is pre-cut and sized into a sheet section 470 for installation as a particular ship's bulkhead 12, as shown in FIG. 6 of the drawings.

The first composite laminated structure 430 includes a first metal layer 432 formed of a metal sheet, a first ceramic layer 434 formed of ceramic fibers, and a first outer layer 438 formed of an intumescent, fire-retardant coating on a fiberglass woven or non-woven textile sheet 439, as depicted in FIG. 5. First metal layer 432 includes a first side 432*a* and a second side 432*b*. First ceramic layer 434 includes a first side 434*a* and a second side 434*b*. First outer layer 438 includes a first side 438*a* and a second side 438*b*. The first composite laminated structure 430 is constructed in the following manner, the first side 432*a* of first metal layer 432 is adjacent and in contact with first side 422 of the inner core layer 420. The second side 432*b* of first metal layer 432 is adjacent and in contact with first side 434*a* of first ceramic layer 434. The second side 434*b* of first ceramic layer 434 is adjacent and in contact with first side 438*a* of first outer layer 438. Second side 438*b* is the outer wall surface of first composite laminated structure 430.

The second composite laminated structure 450 includes a second metal layer 452 formed of a metal sheet, a second ceramic layer 454 formed of ceramic fibers and a second outer layer 458 formed of an intumescent, fire retardant coating on a fiberglass woven or non-woven textile sheet 459, as depicted in FIG. 5 of the drawings. Second metal layer 452 includes a first side 452*a* and a second side 452*b*. Second ceramic layer 454 includes a first side 454*a* and a second side 454*b*. Second outer layer 458 includes a first side 458*a* and a second side 458*b*. The second composite laminated structure 450 is constructed in the following manner, the first side 452*a* of second metal layer 452 is adjacent and in contact with second side 424 of the inner core layer 420. The second side 452*b* of second metal layer 452 is adjacent and in contact with first side 454*a* of second ceramic layer 454. The second side 454*b* of second ceramic layer 454 is adjacent and in contact with first side 458*a* of second outer layer 458. Second side 458*b* is the outer wall surface of second composite laminate structure 450.

Inner core layer 420 is made of a fire retardant and incombustible material selected from the group consisting of mineral wool, rock wool, ceramic blanket, silica blanket, alumina blanket and combinations thereof. Inner core layer 420 of mineral wool has a thickness in the range of ½ of an inch to 3 inches with a preferred thickness of 2 inches, and having a density of at least 1 pound per cubic foot with a preferred density of 4 pounds per cubic foot.

First and second metal layers 432 and 452 are used as metal structural sheets for providing structural integrity to the formed fireproof section 400 and are made of metal sheets selected from the group consisting of steel, stainless steel, aluminum, and alloy layers of steel or aluminum. Metal layers 432 and 452 each have a thickness in the range of 20 mils to 200 mils with a preferred thickness of 30 mils.

First and second ceramic layers 434 and 454 are used as an insulation blanket for reducing the transmission of heat and are made of materials selected from the group consisting of ceramic blankets, silica blankets, alumina blankets, mineral wool, rock wool, fiberglass, leached silica and combinations thereof. Ceramic layers 434 and 454 each have a thickness in the range of 125 mils to 500 mils depending upon the material used, and has a density of at least 4 pounds per cubic foot.

First and second outer layers 438 and 458 are used as the fireproof and fire retardant layers in retarding fire on fireproof section 400, and are made of intumescent, fire retardant coatings on either woven or non-woven textile sheets 439. Further, additional top coat layers 440 and 460 can be applied to first and second outer layers 438 and 458, respectively, in order to increase durability, water resistance, resistance to humidity, resistance to impact, and resistance to chemicals and hydrocarbons. The combined outer layers 438 and 440, and 458 and 460 include the fiberglass textile 439 and 459 having intumescent coatings thereon for resistance to fire, heat, water and impact. Outer layers 438 and 458 each have a thickness in the range of 15 mils to 200 mils with a preferred thickness of 30 mils.

Sheet section 470 includes outer wall surfaces 472 and 474, upper and lower edges 476 and 478 and side edges 480 and 482. The physical measurements of sheet section 470 (in a cut and assembled state), as depicted in FIG. 9 of the drawings has a thickness of 2 inches, and height and width measurements that can be manufactured to any size for the particular ship's bulkhead 12 in which one or more of these sheet sections 470 are installed within the interlocking fireproof bulkhead system 500. Sheet section 470 also includes connecting means 90 for joining two or more sheet sections 470 together. The connecting means 90 include overlap joints 92, half-lap joints 94, tongue and groove joints 96 wherein each of the aforementioned joints are made of metal and also include a pair of barrier overlap members 99, as shown in FIGS. 7 through 10 of the drawings. The barrier overlap members 99 are located on side 482 of each sheet section 470. Each of the male and female members 92*a* and 92*b*, 94*a* and 94*b*, and 96*a* and 96*b*, of the joints 92, 94 and 96, respectively, are located on each side 480 and 482 of each sheet section 470.

DETAILED DESCRIPTION OF THE INTERLOCKING FIREPROOF BULKHEAD SYSTEM 500

The interlocking fireproof bulkhead system 500 of the present invention is represented in FIGS. 6 through 10 of the patent drawings. The interlocking fireproof bulkhead system 500 is used for supporting a plurality of the fireproof sheet sections 70, 170, 270, 370 and 470 of the preferred and alternate embodiments 10, 100, 200, 300 and 400, respectively. Each of the sheet sections 70, 170, 270, 370 and 470 include an upper edge 76, 176, 276, 376 and 476, and a lower edge 78, 178, 278, 378 and 478, respectively. The interlocking bulkhead system 500 includes a plurality of connected ceiling track members 510*a*, 510*b* and 510*c* for slidably receiving the upper edge 76, 176, 276, 376 and 476 of sheet sections 70, 170, 270, 370 and 470, respectively. The interlocking bulkhead system 500 also includes a plurality of connected floor track members 520*a*, 520*b* and 520*c* for slidably receiving the lower edge 78, 178, 278, 378 and 478 of sheet sections 70, 170, 270, 370 and 470, respectively, as depicted in FIG. 6 of the drawings.

Each of the fireproof sheet sections 70, 170, 270, 370 and 470, as shown in FIGS. 6 through 10 of the drawings, includes connecting means 90 for connecting and interlocking two or more of the fireproof sheet sections 70, 70' and 70"; 170 and 170'; 270 and 270'; 370 and 370'; and 470 and 470', respectively. Connecting means 90 include overlap joints 92, half-lap joints 94 and tongue and groove joints 96, wherein each of the aforementioned joints 92, 94 and 96 also include a pair of barrier overlap members 99, as depicted in FIGS. 7 through 10 of the drawings. Barrier overlap members 99 are located on side 82, 182, 282, 382 and 482 of each sheet section 70, 170, 270, 370 and 470, respectively. Barrier overlap members 99 are held in place on the adjacent sheet section 70', 170', 270', 370' and 470' by bolting, riveting 502, fire-retardant duct tape 504, staples 506, laser bonding and the like, for forming a continuous fireproof wall section, as shown in FIGS. 6 through 10 of the drawings. The barrier overlap member 99 are made of an intumescent, fire-retardant coating on a fiberglass sheet 39 and are attached on one of the side edges being adjacent to the front and rear surfaces of each sheet section 70, 170, 270, 370 and 470; as shown in FIGS. 6 through 10 of the drawings.

Overlap joint 92 includes a male insertion member 92*a* and a female receiving member 92*b*, as shown in FIGS. 6 and 7 of the drawings, for interlocking and connecting the overlap joint 92 together for sheet sections 70 and 70', and 170 and 170', respectively. Each of the male and female members 92*a* and 92*b* of overlap joint 92 are located on each side 80 and 82, and 180 and 182 of each sheet section 70 and 170, respectively.

Half-lap joint 94 includes a first receiving member 94*a* and a second receiving member 94*b*, as shown in FIG. 8 of the drawings, for interlocking and joining the half-lap joint 94 together for sheet sections 270 and 270', respectively. Each of the first and second receiving members 94*a* and 94*b* of half-lap joint 94 are located on each side 280 and 282 of sheet section 270, respectively.

Tongue and groove joint 96 includes a male tongue member 96*a* and a female groove member 96*b*, as shown in FIG. 9 of the drawings, for interlocking and joining the tongue and groove joint 96 together for sheet sections 370 and 370', respectively. Each of the tongue and groove members 96*a* and 96*b* of tongue and groove joint 96 are located on each side 380 and 382 of sheet section 370, respectively.

The interlocking sheet sections 70 and 70', 170 and 170', 270 and 270', 370 and 370', and 470 and 470' use a gasket member 91 between the connecting means 90 of the overlap joints 92, half-lap joints 94, and tongue and groove joints 96, respectively, as depicted in FIGS. 6 to 9 of the drawings. The gasket member 91 is attached to one side of the joints 92, 94 or 96 to provide a fireproof and an airtight seal. The gasket member 91 is made of a formable, fire-retardant intumescent coated fiberglass, ceramic blanket, silica blanket or alumina blanket. Gasket member 91 is between each of the male and female members 92*a* and 92*b* of overlap joint 92, as shown in FIG. 7 of the drawings. Gasket member 91 is between each of the first and second receiving members 94*a* and 94*b* of half-lap joint 94, as shown in FIG. 8 of the drawings. Gasket member 91 is between each of the tongue and groove members 96*a* and 96*b* of the tongue and groove joint 96, as shown in FIG. 9 of the drawings.

The interlocking fireproof bulkhead system 500 further includes, as shown in FIG. 6 of the drawings, a plurality of connected wall track members 530*a* and 530*b* for slidably receiving the upper and/or lower edges 76 and 78 of two adjacent (upper and lower) fireproof sheet sections 70U, 70L, 70U' and 70L', respectively. System 500 also includes a plurality of connecting rods 540*a*, 540*b*, 540*c* and 540*d* for connecting to the plurality of connected wall track members 530*a* and 530*b* in order to support the plurality of fireproof sheet sections 70U, 70L, 70U' and 70L' in a vertical position, as shown in FIG. 10 of the drawings.

The interlocking fireproof bulkhead system 500 for a ship's bulkhead 12, as shown in FIG. 6 of the drawings, provides protection to the bulkhead for at least 60 minutes at a temperature of up to 1700 degrees Fahrenheit. The interlocking bulkhead system 500 has a weight of less than 4.5 pounds per square foot using the preferred embodiment 10, has a weight of less than 4.1 pounds per square foot using the first and second alternate embodiments 100 and 200, and has a weight of less than 3.9 pounds per square foot using the third alternate embodiment 300. The physical measurements of the interlocking bulkhead system 500 in an assembled state has a thickness of up to 3 inches, with a height and length of the interlocking bulkhead system 500 that can be manufactured to any size for that particular ship's bulkhead 12. Additionally, each of the sheet sections 70, 170, 270, 370 and 470 can be pre-cut to any size in height and width for easy installation within the ceiling and floor tracking members 510*a*, 510*b*, 510*c* and 520*a*, 520*b*, 520*c*, respectively, of interlocking bulkhead system 500.

EXAMPLES OF USE FOR THE FIREPROOF BULKHEAD SHEET SECTIONS OF THE PRESENT INVENTION

Example 1

A fireproof bulkhead section 70 sample for testing was fabricated having a height and width dimension of 2 feet×2 feet and a thickness of 2 inches. The inner core layer 20 was made of mineral wool having a thickness of 2 inches and a density of 4 lbs per cubic feet. The metal sheet layers 32 and 52 were each made of 18 gauge steel. The ceramic layers 34 and 54 were made of ceramic blankets each having a thickness of ⅛ of an inch and a density of 8 lbs per cubic feet. The metal foil layers 36 and 56 were each made of a NoFire A18™ intumescent, fire-retardant coating on woven fiberglass 39 and 59 (style number 7642/S1), respectively.

The 2 feet×2 feet×2 inch sheet section 70 was installed and positioned on the side of an oven, which was heated with a 100,000 BTU/hour propane burner at 2300 degrees Fahrenheit. The oven temperature was increased according to the requirements of IMO Resolution A.754(18). The temperature of the unexposed surface 74 of the bulkhead section 70 was measured versus time. The temperature of the aforementioned bulkhead section 70 did not exceed 139° Centigrade (282° Fahrenheit) above ambient for in excess of 70 minutes.

APPLICATIONS AND USES OF THE PRESENT INVENTION

The fireproof bulkheads 10, 100, 200, 300 of the present invention can be used in a variety of product applications in which fireproofing is required by various governmental agencies or others. Applications using the fireproof bulkheads 10, 100, 200, 300 can include many different types of transportation conveyances such as ships, boats, submarines, tankers, railway cars, and trains. Within each one of these conveyances there are many areas that require fireproofing such as passenger compartments, common hallways and stairwells, engine rooms, galleys, and magazines and munitions storage areas in military ships.

ADVANTAGES OF THE PRESENT INVENTION

Accordingly, an advantage of the present invention is that it provides for a fireproof bulkhead made from an inner core of an incombustible material such as mineral wool, a middle steel sheet layer, and multiple layers of insulation materials on both sides of the metal sheet layer for use as a fireproof, flame and heat resistant insulation barrier for protecting bulkheads, overheads, and compartments for ships, boats, submarines, railway tanker cars, tanker trucks, and the like.

Another advantage of the present invention is that it provides for a fireproof bulkhead that is thin and lightweight, easily installed, non-toxic materials to humans in the virgin and heated state and has a finished surface for a bulkhead or overhead which requires no top coating or finish coating.

Another advantage of the present invention is that it provides for a fireproof bulkhead that has a low surface flame spread performance that meets the requirements of the International Maritime Organization Resolution A.653(16) and low smoke and toxicity requirement of the IMO Resolution MSC.41(64).

Another advantage of the present invention is that it provides for a fireproof bulkhead having a novel combination of fire retardant materials with the inner core made of incombustible materials such as mineral wool, rock wool, or ceramic blanket; a metal sheet layer made of steel, aluminum or any alloy; a second middle layer of ceramic based material; a metal foil layer made of stainless steel, steel, or aluminum foil; and an outer layer of insulation material made of intumescent, fire retardant coating applied onto a fiberglass material.

Another advantage of the present invention is that it provides for a fireproof bulkhead that can be used in a variety of applications for fireproofing ships, boats, submarines, tankers, trains, and the like.

Another advantage of the present invention is that it provides for a fireproof bulkhead that can be installed on existing ships and is easily installed with simple slide-in overlapping joints requiring no special or additional joinery, taping, or securing.

Another advantage of the present invention is that it provides for a lightweight fireproof bulkhead that is particularly critical in modern high-speed aluminum ferryboats.

Another advantage of the present invention is that it provides for a fireproof bulkhead that meets the sound attenuation requirements of the IMO and the U. S. Coast Guard.

Another advantage of the present invention is that it provides for a fireproof bulkhead that is sturdy, durable, and resistant to normal abrasive wear and tear.

Another advantage of the present invention is that it provides for a fireproof bulkhead that is a completely dry installation requiring no spraying, wiring, meshes, epoxies, glues, or any kind of chemicals or liquids in the installation.

Another advantage of the present invention is that it provides for a fireproof bulkhead that easily accommodates through penetrations for pipes, conduits, cables, etc.

Another advantage of the present invention is that it provides for a fireproof bulkhead that includes a decorative, attractive finish and is available in any color.

Another advantage of the present invention is that provides for a fireproof bulkhead that exceeds the requirements of IMO Resolution A.754(18) and A60.

Another advantage of the present invention is that it provides for a fireproof bulkhead that is inexpensive compared to a typical A60 bulkhead in use today.

A further advantage of the present invention is that it provides for fireproof bulkhead that can be easily manufactured, mass-produced in an automated and economical manner, and is cost-efficient for a variety of applications by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fireproof bulkhead section for a ship, comprising:

a) an inner core layer made of an incombustible fiber material and having a first side for receiving a first composite and a second side for receiving a second composite for forming a fireproof bulkhead section;

b) said first composite having a first metal layer formed of a metal sheet, a first ceramic layer formed of ceramic fibers, a first foil layer formed of a metal foil sheet and a first outer layer formed of an intumescent, fire-retardant coating on a fiberglass sheet;

c) said second composite having a second metal layer formed of a metal sheet, a second ceramic layer formed of ceramic fibers, a second foil layer formed of a metal foil sheet and a second outer layer formed of an intumescent, fire-retardant coating on a fiberglass sheet;

d) connecting means for connecting and interlocking two or more of said fireproof bulkhead sections together;

e) said fireproof bulkhead section providing protection for at least 60 minutes at a temperature of up to 1700° F.; and f) said fireproof bulkhead section having a weight of less than 4.5 lbs per square foot.

2. A fireproof bulkhead section in accordance with claim 1, wherein said incombustible fiber material of said inner core layer is selected from the group consisting of mineral wool, rock wool, ceramic blanket, silica blanket, alumina blanket, fiberglass and combinations thereof.

3. A fireproof bulkhead section in accordance with claim 2, wherein said incombustible fiber material of said inner core layer is mineral wool; said mineral wool has a thickness of at least a ½ inch and has a density of at least 1 pound per cubic foot.

4. A fireproof bulkhead section in accordance with claim 1, wherein said first and second metal layers are metal sheets of steel, stainless steel, aluminum, or alloys of steel or aluminum.

5. A fireproof bulkhead section in accordance with claim 1, wherein each of said metal sheets has a thickness in the range of 15 mils to 250 mils.

6. A fireproof bulkhead section in accordance with claim 1, wherein said ceramic fibers are selected from the group consisting of ceramic blanket, silica blanket, alumina blanket, fiberglass, mineral wool, rock wool and combinations thereof.

7. A fireproof bulkhead section in accordance with claim 1, wherein each of said ceramic layers has a thickness in the range of 125 mils to 500 mils and has a density in the range of 2 pounds per cubic foot to 8 pounds per cubic foot.

8. A fireproof bulkhead section in accordance with claim 1, wherein said first and second foil layers are metal foil sheets of stainless steel, steel, aluminum, copper or tantalum.

9. A fireproof bulkhead section in accordance with claim 1, wherein each of said metal foil sheets has a thickness in the range of 1 mil to 20 mils.

10. A fireproof bulkhead section in accordance with claim 1, wherein said fiberglass sheet is selected from the group consisting of E-type fiberglass, leached fiberglass, silica fibers or combinations thereof.

11. A fireproof bulkhead section in accordance with claim 1, wherein said fiberglass sheet is made of woven textile material or a non-woven textile material, and has a weight in the range of 2 to 60 ounces per square yard.

12. A fireproof bulkhead section in accordance with claim 1, wherein each of said outer layers has a thickness in the range of 15 mils to 150 mils.

13. A fireproof bulkhead section in accordance with claim 1, wherein said intumescent, fire-retardant coating further includes a top layer resistant coating for increased durability and resistance to water, impact, chemicals, hydrocarbons, and acids.

14. A fireproof bulkhead section in accordance with claim 1, wherein said connecting means is in the form of an overlap joint, a half lapped joint, or a tongue and groove joint, with each joint having a pair of barrier overlap members thereon.

15. A fireproof bulkhead section in accordance with claim 14, wherein said barrier overlap member is made of an intumescent, fire-retardant coating on a fiberglass sheet.

16. An interlocking fireproof bulkhead system for supporting a plurality of fireproof bulkhead sections for a ship's bulkhead, comprising:

a) a plurality of fireproof bulkhead sections each having an upper edge, a lower edge, a front surface, a rear surface and side edges;

b) a plurality of connected ceiling track members for slidably receiving said upper edges of said plurality of fireproof bulkhead sections;

c) a plurality of connected floor track members for slidably receiving said lower edges of said plurality of fireproof bulkhead sections;

d) each of said fireproof bulkhead sections having connecting means for connecting and interlocking two or more of said fireproof bulkhead sections together;

e) each of said fireproof bulkhead sections includes an inner core layer made of an incombustible fiber material and having a first side for receiving a first composite and a second side for receiving a second composite for forming said fireproof bulkhead section;

f) said first composite having a first metal layer formed of a metal sheet, a first ceramic layer formed of ceramic fibers, a first foil layer formed of a metal foil sheet and a first outer layer formed of an intumescent, fire-retardant coating on a fiberglass sheet;

g) said second composite having a second metal layer formed of a metal sheet, a second ceramic layer formed of ceramic fibers, a second foil layer formed of a metal foil sheet and a second outer layer formed of an intumescent, fire-retardant coating on a fiberglass sheet;

h) said fireproof bulkhead system providing protection for at least 60 minutes at a temperature of up to 1700° F.; and i) said fireproof bulkhead system having a weight of less than 4.5 lbs per square foot.

17. A fireproof bulkhead system in accordance with claim 16, wherein said incombustible fiber material of said inner core layer is selected from the group consisting of mineral wool, rock wool, ceramic blanket, silica blanket, alumina blanket, fiberglass and combinations thereof.

18. A fireproof bulkhead system in accordance with claim 17, wherein said incombustible fiber material of said inner core layer is mineral wool, said mineral wool has a thickness of at least a ½ inch and has a density of at least 1 pound per cubic foot.

19. A fireproof bulkhead system in accordance with claim 16, wherein said first and second metal layers are metal sheets of steel, stainless steel, aluminum, or alloys of steel or aluminum.

20. A fireproof bulkhead system in accordance with claim 16, wherein each of said metal sheets has a thickness in the range of 15 mils to 250 mils.

21. A fireproof bulkhead system in accordance with claim 16, wherein said ceramic fibers are selected from the group consisting of ceramic blanket, silica blanket, alumina blanket, fiberglass, mineral wool, rock wool and combinations thereof.

22. A fireproof bulkhead system in accordance with claim 16, wherein each of said ceramic layers has a thickness in the range of 125 mils to 500 mils and has a density in the range of 2 pounds per cubic foot to 8 pounds per cubic foot.

23. A fireproof bulkhead system in accordance with claim 16, wherein said first and second foil layers are metal foil sheets of stainless steel, steel, aluminum, copper or tantalum.

24. A fireproof bulkhead system in accordance with claim 16, wherein each of said metal foil sheets has a thickness in the range of 1 mil to 20 mils.

25. A fireproof bulkhead system in accordance with claim 16, wherein said fiberglass sheet is selected from the group consisting of E-type fiberglass, leached fiberglass, silica fibers or combinations thereof.

26. A fireproof bulkhead system in accordance with claim 16, wherein said fiberglass sheet is made of woven textile material or a non-woven textile material, and has a weight in the range of 2 to 60 ounces per square yard.

27. A fireproof bulkhead system in accordance with claim 16, wherein each of said outer layers has a thickness in the range of 15 mils to 150 mils.

28. A fireproof bulkhead system in accordance with claim 16, wherein said intumescent, fire-retardant coating further includes a top layer resistant coating for increased durability and resistance to water, impact, chemicals, hydrocarbons, and acids.

29. A fireproof bulkhead system in accordance with claim 16, wherein said connecting means is in the form of an overlap joint, a half lapped joint, or a tongue and groove joint, with each joint having a pair of barrier overlap members thereon.

30. A fireproof bulkhead system in accordance with claim 29, wherein said barrier overlap member is made of an intumescent, fire-retardant coating on a fiberglass sheet.

31. A fireproof bulkhead system in accordance with claim 29, wherein each of said barrier overlap members are attached on one of said side edges being adjacent to said front and rear surfaces of said fireproof bulkhead section.

32. A fireproof bulkhead system in accordance with claim 29, wherein each of said barrier overlap members are attached on one of said side edges being adjacent to said front and rear surfaces of said fireproof bulkhead section; and said attachment means including riveting, bolting, stapling, laser bonding or taping.

33. A fireproof bulkhead system in accordance with claim 16, further including a plurality of connected wall track members for slidably receiving said upper and/or lower edges of said plurality of fireproof sections.

34. A fireproof bulkhead system in accordance with claim 33, further including a plurality of connecting rods connected to said plurality of connected wall track members for supporting said plurality of fireproof sections in a vertical position.

35. A fireproof bulkhead section for a ship, comprising:

a) an inner core layer made of an incombustible fiber material and having a first side for receiving a first composite and a second side for receiving a second composite for forming a fireproof bulkhead section;

b) said first composite having a first metal layer formed of a metal sheet, a first foil layer formed of a metal foil sheet and a first outer layer formed of an intumescent, fire-retardant coating on a fiberglass sheet;

c) said second composite having a second metal layer formed of a metal sheet, a second foil layer formed of a metal foil sheet and a second outer layer formed of an intumescent, fire-retardant coating on a fiberglass sheet;

d) connecting means for connecting and interlocking two or more of said fireproof bulkhead sections together;

e) said fireproof bulkhead section providing protection for at least 60 minutes at a temperature of up to 1700° F.; and f) said fireproof bulkhead section having a weight of less than 4.1 lbs per square foot.

36. A fireproof bulkhead section in accordance with claim 35, wherein said incombustible fiber material of said inner core layer is selected from the group consisting of mineral wool, rock wool, ceramic blanket, silica blanket, alumina blanket, fiberglass and combinations thereof.

37. A fireproof bulkhead section in accordance with claim 36, wherein said incombustible fiber material of said inner core layer is mineral wool; said mineral wool has a thickness of at least a ½ inch and has a density of at least 1 pound per cubic foot.

38. A fireproof bulkhead section in accordance with claim 35, wherein said first and second metal layers are metal sheets of steel, stainless steel, aluminum, or alloys of steel or aluminum.

39. A fireproof bulkhead section in accordance with claim 35, wherein each of said metal sheets has a thickness in the range of 15 mils to 250 mils.

40. A fireproof bulkhead section in accordance with claim 35, wherein said first and second foil layers are metal foil sheets of stainless steel, steel, aluminum, copper or tantalum.

41. A fireproof bulkhead section in accordance with claim 35, wherein each of said metal foil sheets has a thickness in the range of 1 mil to 20 mils.

42. A fireproof bulkhead section in accordance with claim 35, wherein said fiberglass sheet is selected from the group consisting of E-type fiberglass, leached fiberglass, silica fibers or combinations thereof.

43. A fireproof bulkhead section in accordance with claim 35, wherein said fiberglass sheet is made of woven textile material or a non-woven textile material, and has a weight in the range of 2 to 60 ounces per square yard.

44. A fireproof bulkhead section in accordance with claim 35, wherein each of said outer layers has a thickness in the range of 15 mils to 150 mils.

45. A fireproof bulkhead section in accordance with claim 35, wherein said intumescent, fire-retardant coating further includes a top layer resistant coating for increased durability and resistance to water, impact, chemicals, hydrocarbons, and acids.

46. A fireproof bulkhead section in accordance with claim 35, wherein said connecting means is in the form of an overlap joint, a half lapped joint, or a tongue and groove joint, with each joint having a pair of barrier overlap members thereon.

47. A fireproof bulkhead section in accordance with claim 35, wherein said barrier overlap member is made of an intumescent, fire-retardant coating on a fiberglass sheet.

48. An interlocking fireproof bulkhead system for supporting a plurality of fireproof bulkhead sections for a ship's bulkhead, comprising:

a) a plurality of fireproof bulkhead sections each having an upper edge, a lower edge, a front surface, a rear surface and side edges;

b) a plurality of connected ceiling track members for slidably receiving said upper edges of said plurality of fireproof bulkhead sections;

c) a plurality of connected floor track members for slidably receiving said lower edges of said plurality of fireproof bulkhead sections;

d) each of said fireproof bulkhead sections having connecting means for connecting and interlocking two or more of said fireproof bulkhead sections together;

e) each of said fireproof bulkhead sections includes an inner core layer made of an incombustible fiber material and having a first side for receiving a first composite and a second side for receiving a second composite for forming said fireproof bulkhead section;

f) said first composite having a first metal layer formed of a metal sheet, a first foil layer formed of a metal foil sheet and a first outer layer formed of an intumescent, fire-retardant coating on a fiberglass sheet;

g) said second composite having a second metal layer formed of a metal sheet, a second foil layer formed of a metal foil sheet and a second outer layer formed of an intumescent, fire-retardant coating on a fiberglass sheet;

h) said fireproof bulkhead system providing protection for at least 60 minutes at a temperature of up to 1700° F.; and i) said fireproof bulkhead system having a weight of less than 4.1 lbs per fit square foot.

49. A fireproof bulkhead system in accordance with claim 48, wherein said incombustible fiber material of said inner core layer is selected from the group consisting of mineral wool, rock wool, ceramic blanket, silica blanket, alumina blanket, fiberglass and combinations thereof.

50. A fireproof bulkhead system in accordance with claim 49, wherein said incombustible fiber material of said inner core layer is mineral wool; said mineral wool has a thickness of at least a ½ inch and has a density of at least 1 pound per cubic foot.

51. A fireproof bulkhead system in accordance with claim 48, wherein said first and second metal layers are metal sheets of steel, stainless steel, aluminum, or alloys of steel or aluminum.

52. A fireproof bulkhead system in accordance with claim 48, wherein each of said metal sheets has a thickness in the range of 15 mils to 250 mils.

53. A fireproof bulkhead system in accordance with claim 48, wherein said first and second foil layers are metal foil sheets of stainless steel, steel, aluminum, copper or tantalum.

54. A fireproof bulkhead system in accordance with claim 48, wherein each of said metal foil sheets has a thickness in the range of 1 mil to 20 mils.

55. A fireproof bulkhead system in accordance with claim 48, wherein said fiberglass sheet is selected from the group consisting of E-type fiberglass, leached fiberglass, silica fibers or combinations thereof.

56. A fireproof bulkhead system in accordance with claim 48, wherein said fiberglass sheet is made of woven textile material or a non-woven textile material, and has a weight in the range of 2 to 60 ounces per square yard.

57. A fireproof bulkhead system in accordance with claim 48, wherein each of said outer layers has a thickness in the range of 15 mils to 150 mils.

58. A fireproof bulkhead system in accordance with claim 48, wherein said intumescent, fire-retardant coating further includes a top layer resistant coating for increased durability and resistance to water, impact, chemicals, hydrocarbons, and acids.

59. A fireproof bulkhead system in accordance with claim 48, wherein said connecting means is in the form of an overlap joint, a half lapped joint, or a tongue and groove joint, with each joint having a pair of barrier overlap members thereon.

60. A fireproof bulkhead system in accordance with claim 59, wherein said barrier overlap member is made of an intumescent, fire-retardant coating on a fiberglass sheet.

61. A fireproof bulkhead system in accordance with claim 59, wherein each of said barrier overlap members are attached on one of said side edges being adjacent to said front and rear surfaces of said fireproof bulkhead section.

62. A fireproof bulkhead system in accordance with claim 59, wherein each of said barrier overlap members are attached and connected by attachment means to an adjacent fireproof bulkhead section for providing a continuous wall section in said fireproof bulkhead paneling system; and said attachment means including riveting, bolting, stapling, laser bonding or taping.

63. A fireproof bulkhead system in accordance with claim 48, further including a plurality of connected wall track members for slidably receiving said upper and/or lower edges of said plurality of fireproof sections.

64. A fireproof bulkhead system in accordance with claim 63, further including a plurality of connecting rods connected to said plurality of connected wall track members for supporting said plurality of fireproof sections in a vertical position.

65. A fireproof bulkhead section for a ship, comprising:

a) an inner core layer made of an incombustible fiber material and having a first side for receiving a first composite and a second side for receiving a second composite for forming a fireproof bulkhead section;

b) said first composite having a first metal layer formed of a metal sheet, and a first outer layer formed of an intumescent, fire-retardant coating on a fiberglass sheet;

c) said second composite having a second metal layer formed of a metal sheet, and a second outer layer formed of an intumescent, fire-retardant coating on a fiberglass sheet;

d) connecting means for connecting and interlocking two or more of said fireproof bulkhead sections together;

e) said fireproof bulkhead section providing protection for at least 60 minutes at a temperature of up to 1700° F.; and f) said fireproof bulkhead section having a weight of less than 4.1 lbs per square foot.

66. A fireproof bulkhead section in accordance with claim 65, wherein said incombustible fiber material of said inner core layer is selected from the group consisting of mineral wool, rock wool, ceramic blanket, silica blanket, alumina blanket, fiberglass and combinations thereof.

67. A fireproof bulkhead section in accordance with claim 66, wherein said incombustible fiber material of said inner core layer is mineral wool; said mineral wool has a thickness of at least a ½ inch and has a density of at least 1 pound per cubic foot.

68. A fireproof bulkhead section in accordance with claim 65, wherein said first and second metal layers are metal sheets of steel, stainless steel, aluminum, or alloys of steel or aluminum.

69. A fireproof bulkhead section in accordance with claim 65, wherein each of in said metal sheets has a thickness in the range of 15 mils to 250 mils.

70. A fireproof bulkhead section in accordance with claim 65, wherein said fiberglass sheet is selected from the group consisting of E-type fiberglass, leached fiberglass, silica fibers or combinations thereof.

71. A fireproof bulkhead section in accordance with claim 65, wherein said fiberglass sheet is made of woven textile material or a non-woven textile material, and has a weight in the range of 2 to 60 ounces per square yard.

72. A fireproof bulkhead section in accordance with claim 65, wherein each of said outer layers has a thickness in the range of 15 mils to 150 mils.

73. A fireproof bulkhead section in accordance with claim 65, wherein said intumescent, fire-retardant coating further includes a top layer resistant coating for increased durability and resistance to water, impact, chemicals, hydrocarbons, and acids.

74. A fireproof bulkhead section in accordance with claim 65, wherein said connecting means is in the form of an overlap joint, a half lapped joint, or a tongue and groove joint, with each joint having a pair of barrier overlap members thereon.

75. A fireproof bulkhead section in accordance with claim 74, wherein said barrier overlap member is made of an intumescent, fire-retardant coating on a fiberglass sheet.

76. A fireproof bulkhead section in accordance with claim 65, wherein said first and second composites further include first and second ceramic layers formed of ceramic fibers, wherein said first ceramic layer is between said first metal layer and said first outer layer and wherein said second ceramic layer is between said second metal layer and said second outer layer.

77. An interlocking fireproof bulkhead system for supporting a plurality of fireproof bulkhead sections for a ship's bulkhead, comprising:

a) a plurality of fireproof bulkhead sections each having an upper edge, a lower edge, a front surface, a rear surface and side edges;

b) a plurality of connected ceiling track members for slidably receiving said upper edges of said plurality of fireproof bulkhead sections;

c) a plurality of connected floor track members for slidably receiving said lower edges of said plurality of fireproof bulkhead sections;

d) each of said fireproof bulkhead sections having connecting means for connecting and interlocking two or more of said fireproof bulkhead sections together;

e) each of said fireproof bulkhead sections includes an inner core layer made of an incombustible fiber material and having a first side for receiving a first composite and a second side for receiving a second composite for forming said fireproof bulkhead section;

f) said first composite having a first metal layer formed of a metal sheet, and a first outer layer formed of an intumescent, fire-retardant coating on a fiberglass sheet;

g) said second composite having a second metal layer formed of a metal sheet, and a second outer layer formed of an intumescent, fire-retardant coating on a fiberglass sheet;

h) said fireproof bulkhead system providing protection for at least 60 minutes at a temperature of up to 1700° F.; and i) said fireproof bulkhead system having a weight of less than 4.1 lbs per square foot.

78. A fireproof bulkhead system in accordance with claim 77, wherein said incombustible fiber material of said inner core layer is selected from the group consisting of mineral wool, rock wool, ceramic blanket, silica blanket, alumina blanket, fiberglass and combinations thereof.

79. A fireproof bulkhead system in accordance with claim 78, wherein said incombustible fiber material of said inner core layer is mineral wool; said mineral wool has a thickness of at least a ½ inch and has a density of at least 1 pound per cubic foot.

80. A fireproof bulkhead system in accordance with claim 77, wherein said first and second metal layers are metal sheets of steel, stainless steel, aluminum, or alloys of steel or aluminum.

81. A fireproof bulkhead system in accordance with claim 77, wherein each of said metal sheets has a thickness in the range of 15 mils to 250 mils.

82. A fireproof bulkhead system in accordance with claim 77, wherein said fiberglass sheet is selected from the group consisting of E-type fiberglass, leached fiberglass, silica fibers or combinations thereof.

83. A fireproof bulkhead system in accordance with claim 77, wherein said fiberglass sheet is made of woven textile material or a non-woven textile material, and has a weight in the range of 2 to 60 ounces per square yard.

84. A fireproof bulkhead system in accordance with claim 77, wherein each of said outer layers has a thickness in the range of 15 mils to 150 mils.

85. A fireproof bulkhead system in accordance with claim 77, wherein said intumescent, fire-retardant coating further includes a top layer resistant coating for increased durability and resistance to water, impact, chemicals, hydrocarbons, and acids.

86. A fireproof bulkhead system in accordance with claim 77, wherein said connecting means is in the form of an overlap joint, a half lapped joint, or a tongue and groove joint, with each joint having a pair of barrier overlap members thereon.

87. A fireproof bulkhead system in accordance with claim 86, wherein said barrier overlap member is made of an intumescent, fire-retardant coating on a fiberglass sheet.

88. A fireproof bulkhead system in accordance with claim 86, wherein each of said barrier overlap members are attached on one of said side edges being adjacent to said front and rear surfaces of said fireproof bulkhead section.

89. A fireproof bulkhead system in accordance with claim 86, wherein each of said barrier overlap members are attached and connected by attachment means to an adjacent fireproof bulkhead section for providing a continuous wall section in said fireproof bulkhead paneling system; and said attachment means including riveting, bolting, stapling, laser bonding or taping.

90. A fireproof bulkhead system in accordance with claim 77, further including a plurality of connected wall track members for slidably receiving said upper and/or lower edges of said plurality of fireproof sections.

91. A fireproof bulkhead system in accordance with claim 90, further including a plurality of connecting rods connected to said plurality of connected wall track members for supporting said plurality of fireproof sections in a vertical position.

92. A fireproof bulkhead system in accordance with claim 77, wherein said first and second composites further include first and second ceramic layers formed of ceramic fibers, wherein said first ceramic layer is between said first metal layer and said first outer layer and wherein said second ceramic layer is between said second metal layer and said second outer layer.

93. A fireproof bulkhead section for a ship, comprising:

a) an inner core layer made of an incombustible fiber material and having a first side for receiving a first composite and a second side for receiving a second composite for forming a fireproof bulkhead section;

b) said first composite having a first metal layer formed of a metal sheet; and a first outer layer formed of an intumescent, fire-retardant coating;

c) said second composite having a second metal layer formed of a metal sheet, and a second outer layer formed of an intumescent, fire-retardant coating;

d) connecting means for connecting and interlocking two or more of said fireproof bulkhead sections together; said connecting means being in the form of an overlap joint, a half lapped joint, or a tongue and groove joint, with each joint having a pair of barrier overlap members thereon;

e) each of said barrier overlap members is made of an intumescent, fire-retardant coating on a fiberglass sheet;

f) said fireproof bulkhead section providing protection for at least 60 minutes at a temperature of up to 1700° F.; and g) said fireproof bulkhead section having a weight of less than 3.9 lbs per square foot.

94. A fireproof bulkhead section in accordance with claim 93, wherein said incombustible fiber material of said inner core layer is selected from the group consisting of mineral wool, rock wool, ceramic blanket, silica blanket, alumina blanket, fiberglass and combinations thereof.

95. A fireproof bulkhead section in accordance with claim 94, wherein said incombustible fiber material of said inner core layer is mineral wool; said mineral wool has a thickness of at least a ½ inch and has a density of at least 1 pound per cubic foot.

96. A fireproof bulkhead section in accordance with claim 93, wherein said first and second metal layers are metal sheets of steel, stainless steel, aluminum, or alloys of steel or aluminum.

97. A fireproof bulkhead section in accordance with claim 93, wherein each of said metal sheets has a thickness in the range of 15 mils to 250 mils.

98. A fireproof bulkhead section in accordance with claim 93, wherein each of said outer layers has a thickness in the range of 15 mils to 150 mils.

99. A fireproof bulkhead section in accordance with claim 93, wherein said intumescent, fire-retardant coating further includes a top layer resistant coating for increased durability and resistance to water, impact, chemicals, hydrocarbons, and acids.

100. An interlocking fireproof bulkhead system for supporting a plurality of fireproof bulkhead sections for a ship's bulkhead, comprising:

a) a plurality of fireproof bulkhead sections each having an upper edge, a lower edge, a front surface, a rear surface and side edges;

b) a plurality of connected ceiling track members for slidably receiving said upper edges of said plurality of fireproof bulkhead sections;

c) a plurality of connected floor track members for slidably receiving said lower edges of said plurality of fireproof bulkhead sections;

d) each of said fireproof bulkhead sections having connecting means for connecting and interlocking two or more of said fireproof bulkhead sections together; said connecting means being in the form of an overlap joint, a half lapped joint, or a tongue and groove joint, with each joint having a pair of barrier overlap members thereon;

e) each of said barrier overlap members is made of an intumescent, fire-retardant coating on a fiberglass sheet;

f) each of said fireproof bulkhead sections includes an inner core layer made of an incombustible fiber material and having a first side for receiving a first composite and a second side for receiving a second composite for forming said fireproof bulkhead section;

g) said first composite having a first metal layer formed of a metal sheet, and a first outer layer formed of an intumescent, fire-retardant coating;

h) said second composite having a second metal layer formed of a metal sheet, and a second outer layer formed of an intumescent, fire-retardant coating;

i) said fireproof bulkhead system providing protection for at least 60 minutes at a temperature of up to 1700° F.; and j) said fireproof bulkhead system having a weight of less than 3.9 lbs per square foot.

101. A fireproof bulkhead system in accordance with claim 100, wherein said incombustible fiber material of said inner core layer is selected from the group consisting of mineral wool, rock wool, ceramic blanket, silica blanket, alumina blanket, fiberglass and combinations thereof.

102. A fireproof bulkhead system in accordance with claim 101, wherein said incombustible fiber material of said inner core layer is mineral wool; said mineral wool has a thickness of at least a ½ inch and has a density of at least 1 pound per cubic foot.

103. A fireproof bulkhead system in accordance with claim 100, wherein said first and second metal layers are metal sheets of steel, stainless steel, aluminum, or alloys of steel or aluminum.

104. A fireproof bulkhead system in accordance with claim 100, wherein each of said metal sheets has a thickness in the range of 15 mils to 250 mils.

105. A fireproof bulkhead system in accordance with claim 100, wherein each of said outer layers has a thickness in the range of 15 mils to 150 mils.

106. A fireproof bulkhead system in accordance with claim 100, wherein said intumescent, fire-retardant coating further includes a top layer resistant coating for increased durability and resistance to water, impact, chemicals, hydrocarbons, and acids.

107. A fireproof bulkhead system in accordance with claim 100, wherein each of said barrier overlap members are attached on one of said side edges being adjacent to said front and rear surfaces of said fireproof bulkhead section.

108. A fireproof bulkhead system in accordance with claim 100, wherein each of said barrier overlap members are attached and connected by attachment means to an adjacent fireproof bulkhead section for providing a continuous wall section in said fireproof bulkhead paneling system; and said attachment means including riveting, bolting, stapling, laser bonding and taping.

109. A fireproof bulkhead system in accordance with claim 100, further including a plurality of connected wall track members for slidably receiving said upper and/or lower edges of said plurality of fireproof sections.

110. A fireproof bulkhead system in accordance with claim 109, further including a plurality of connecting rods connected to said plurality of connected wall track members for supporting said plurality of fireproof sections in a vertical position.

111. An interlocking fireproof bulkhead system for supporting a plurality of fireproof bulkhead sections for a ship's bulkhead, comprising:

a) a plurality of fireproof bulkhead sections each having an upper edge, a lower edge, a front surface, a rear surface and side edges;

b) a plurality of connected ceiling track members for slidably receiving said upper edges of said plurality of fireproof bulkhead sections;

c) a plurality of connected floor track members for slidably receiving said lower edges of said plurality of fireproof bulkhead sections;

d) a plurality of connected wall track members for slidably receiving said upper and/or lower edges of said plurality of fireproof sections;

e) a plurality of connecting rods connected to said plurality of connected wall track members for supporting said plurality of fireproof sections in a vertical position;

f) each of said fireproof bulkhead sections having connecting means for connecting and interlocking two or more of said fireproof bulkhead sections together;

g) each of said fireproof bulkhead sections includes an inner core layer made of an incombustible fiber material and having a first side for receiving a first composite and a second side for receiving a second composite for forming said fireproof bulkhead section;

h) said first composite having a first metal layer formed of a metal sheet, and a first outer layer formed of an intumescent, fire-retardant coating;

i) said second composite having a second metal layer formed of a metal sheet, and a second outer layer formed of an intumescent, fire-retardant coating;

j) said fireproof bulkhead system providing protection for at least 60 minutes at a temperature of up to 1700° F.; and k) said fireproof bulkhead system having a weight of less than 3.9 lbs per square foot.

* * * * *